US009541255B2

(12) United States Patent
Sferra et al.

(10) Patent No.: US 9,541,255 B2
(45) Date of Patent: Jan. 10, 2017

(54) LUMINAIRES AND REFLECTOR MODULES

(71) Applicant: LSI Industries, Inc., Cincinnati, OH (US)

(72) Inventors: James P. Sferra, Goshen, OH (US); John D. Boyer, Lebanon, OH (US); James G. Vanden Eynden, Hamilton, OH (US); Larry A. Akers, Clarksville, OH (US); Brian J. Orth, Cincinnati, OH (US)

(73) Assignee: LSI Industries, Inc., Cincinnati, OH (US)

( * ) Notice: Subject to any disclaimer, the term of this patent is extended or adjusted under 35 U.S.C. 154(b) by 83 days.

(21) Appl. No.: 14/288,512

(22) Filed: May 28, 2014

(65) Prior Publication Data

US 2015/0345741 A1 Dec. 3, 2015

(51) Int. Cl.

| | |
|---|---|
| ***F21V 7/00*** | (2006.01) |
| ***F21V 7/10*** | (2006.01) |
| *F21Y 101/00* | (2016.01) |
| *F21W 131/10* | (2006.01) |

(52) U.S. Cl.

CPC ..... *F21V 7/0066* (2013.01); *F21V 7/0083* (2013.01); *F21V 7/10* (2013.01); *F21W 2131/10* (2013.01); *F21Y 2101/00* (2013.01); *F21Y 2105/16* (2016.08)

(58) Field of Classification Search

CPC ..... F21K 99/00; F21V 7/00; F21V 7/04; F21V 5/04; F21V 5/007; F21V 5/08; F21V 7/05; F21V 7/22; F21S 2/00; F21Y 2101/02; F21Y 2101/00; F21Y 2105/001; F21Y 2105/16; F21W 2131/10

See application file for complete search history.

(56) References Cited

U.S. PATENT DOCUMENTS

| | | | |
|---|---|---|---|
| 4,425,603 | A | 1/1984 | Courson |
| 4,617,612 | A | 10/1986 | Pritchett |
| 5,519,596 | A | 5/1996 | Woolverton |
| 5,561,346 | A | 10/1996 | Byrne |
| 5,642,933 | A | 7/1997 | Hitora |
| 6,113,247 | A | 9/2000 | Adams et al. |
| 6,474,848 | B1 | 11/2002 | Lahner et al. |
| 6,808,299 | B2 | 10/2004 | Wijbenga et al. |
| 6,818,864 | B2 | 11/2004 | Ptak |

(Continued)

FOREIGN PATENT DOCUMENTS

| | | |
|---|---|---|
| AU | 2008200821 | 4/2009 |
| CN | 1698202 | 11/2005 |

(Continued)

OTHER PUBLICATIONS

Flexcon Product Construction Sheet (2014).
PureForm Specification Grade LED Luminaires (2013).
Alanod Product Data Sheet (2013).

*Primary Examiner* — Andrew Coughlin
*Assistant Examiner* — Fatima Farokhrooz
(74) *Attorney, Agent, or Firm* — McDermott Will & Emery LLP

(57) ABSTRACT

A luminaire and reflector module for the luminaire are disclosed wherein the reflector has a base plate defining a plurality of reflector light source apertures and a plurality of reflectors extending integrally and individually from the base plate adjacent to the light source apertures.

27 Claims, 14 Drawing Sheets

(56) References Cited

U.S. PATENT DOCUMENTS

| | | | | |
|---|---|---|---|---|
| 6,840,654 | B2 | 1/2005 | Guerrieri et al. | |
| 6,874,911 | B2 | 4/2005 | Yoneda | |
| 7,173,216 | B2 | 2/2007 | Ptak | |
| 7,182,627 | B1 | 2/2007 | Huang | |
| 7,217,009 | B2 | 5/2007 | Klose | |
| 7,284,881 | B2 | 10/2007 | Kim et al. | |
| 7,285,903 | B2 | 10/2007 | Cull et al. | |
| 7,293,906 | B2 | 11/2007 | Mok et al. | |
| 7,311,431 | B2 | 12/2007 | Chew et al. | |
| 7,461,952 | B2 | 12/2008 | Trenchardl et al. | |
| 7,507,462 | B2 | 3/2009 | Teramoto | |
| 7,588,355 | B1 | 9/2009 | Liu et al. | |
| 7,611,264 | B1 | 11/2009 | Chang et al. | |
| 7,665,866 | B2 | 2/2010 | Mayer et al. | |
| 7,782,418 | B2 | 8/2010 | Ke et al. | |
| 7,828,456 | B2 | 11/2010 | Boyer et al. | |
| 7,841,738 | B2 | 11/2010 | Engel | |
| 7,887,216 | B2 | 2/2011 | Patrick | |
| 7,896,514 | B2 | 3/2011 | Gomi | |
| 7,934,851 | B1 * | 5/2011 | Boissevain | F21S 2/005 362/241 |
| 7,967,462 | B2 | 6/2011 | Ogiro et al. | |
| 8,002,428 | B2 | 8/2011 | Boyer et al. | |
| 8,038,314 | B2 | 10/2011 | Ladewig | |
| 8,038,321 | B1 | 10/2011 | Franck et al. | |
| 8,042,968 | B2 | 10/2011 | Boyer et al. | |
| 8,106,568 | B2 | 1/2012 | Kao et al. | |
| 8,128,266 | B2 | 3/2012 | Shen | |
| 8,136,963 | B2 | 3/2012 | Wang | |
| 8,152,333 | B2 | 4/2012 | Boyer | |
| 8,167,466 | B2 | 5/2012 | Liu | |
| 8,177,386 | B2 | 5/2012 | Boyer et al. | |
| 8,210,724 | B2 | 7/2012 | Ying | |
| 8,215,799 | B2 | 7/2012 | Vanden Eynden et al. | |
| 8,220,961 | B2 | 7/2012 | Belknap et al. | |
| 8,226,259 | B2 | 7/2012 | Van Pieterson et al. | |
| 8,382,334 | B2 | 2/2013 | Vanden Eynden et al. | |
| 8,434,893 | B2 | 5/2013 | Boyer et al. | |
| 8,471,281 | B2 | 6/2013 | Jagt | |
| 8,480,264 | B2 | 7/2013 | Vanden Eynden et al. | |
| 8,496,360 | B2 | 7/2013 | Phillips, III et al. | |
| 8,534,868 | B2 | 9/2013 | Salters et al. | |
| 8,550,670 | B2 | 10/2013 | Boyer et al. | |
| 8,567,983 | B2 | 10/2013 | Boyer et al. | |
| 8,696,171 | B2 | 4/2014 | Vanden Eynden et al. | |
| 2004/0188593 | A1 | 9/2004 | Mullins et al. | |
| 2006/0007553 | A1 | 1/2006 | Bogner et al. | |
| 2006/0209541 | A1 | 9/2006 | Peck | |
| 2006/0245208 | A1 | 11/2006 | Sakamoto et al. | |
| 2007/0002572 | A1 | 1/2007 | Ewig et al. | |
| 2008/0278957 | A1 | 11/2008 | Pickard et al. | |
| 2009/0034247 | A1 | 2/2009 | Boyer | |
| 2009/0103288 | A1 * | 4/2009 | Boyer | F21V 7/04 362/153.1 |
| 2009/0201668 | A1 | 8/2009 | Ogiro et al. | |
| 2009/0219720 | A1 | 9/2009 | Reed | |
| 2009/0225543 | A1 | 9/2009 | Jacobson et al. | |
| 2009/0262543 | A1 | 10/2009 | Ho | |
| 2009/0303715 | A1 | 12/2009 | Takasago et al. | |
| 2009/0323330 | A1 | 12/2009 | Gordin et al. | |
| 2010/0019689 | A1 | 1/2010 | Shan | |
| 2010/0027254 | A1 | 2/2010 | Nakayama | |
| 2010/0073925 | A1 | 3/2010 | Vissenberg et al. | |
| 2010/0118531 | A1 | 5/2010 | Montagne | |
| 2010/0142201 | A1 | 6/2010 | Venturini | |
| 2010/0172152 | A1 | 7/2010 | Boonekamp | |
| 2010/0188847 | A1 | 7/2010 | Chen | |
| 2010/0277916 | A1 | 11/2010 | Kira | |
| 2011/0122618 | A1 | 5/2011 | Gantenbrink | |
| 2011/0141767 | A1 | 6/2011 | Box et al. | |
| 2011/0157885 | A1 * | 6/2011 | Visser | F21V 5/002 362/235 |
| 2011/0188233 | A1 | 8/2011 | Josefowicz et al. | |
| 2011/0205738 | A1 | 8/2011 | Peifer et al. | |
| 2012/0002411 | A1 | 1/2012 | Ladewig | |
| 2012/0106148 | A1 | 5/2012 | De Silva | |
| 2012/0147603 | A1 | 6/2012 | Hochstein | |
| 2012/0182713 | A1 | 7/2012 | Bretschneider | |
| 2012/0294036 | A1 | 11/2012 | Tang | |
| 2013/0044475 | A1 | 2/2013 | Hutchens | |
| 2013/0051016 | A1 | 2/2013 | Boyer et al. | |
| 2013/0077295 | A1 * | 3/2013 | Hayashi | F21V 29/00 362/217.05 |
| 2013/0105832 | A1 | 5/2013 | Peters et al. | |
| 2013/0107518 | A1 | 5/2013 | Boyer et al. | |
| 2013/0107527 | A1 | 5/2013 | Boyer et al. | |
| 2013/0107528 | A1 | 5/2013 | Boyer et al. | |
| 2013/0114295 | A1 | 5/2013 | Urtiga | |
| 2013/0229827 | A1 | 9/2013 | Takase | |
| 2014/0063802 | A1 * | 3/2014 | Garcia | F21V 5/007 362/241 |
| 2016/0069533 | A1 * | 3/2016 | Schmidt | F21V 7/0083 362/225 |

FOREIGN PATENT DOCUMENTS

| | | |
|---|---|---|
| EP | 1496488 | 1/2005 |
| EP | 1818607 | 8/2007 |
| EP | 2019250 | 1/2009 |
| EP | 2587133 | 5/2013 |
| JP | 48-22692 | 7/1973 |
| JP | 11-175011 | 7/1999 |
| JP | 2004-006317 | 1/2004 |
| JP | 2006156192 | 6/2006 |
| JP | 2006-520518 | 9/2006 |
| JP | 2006-332024 | 12/2006 |
| NZ | 228553 | 11/1990 |
| WO | 2004/068182 | 8/2004 |
| WO | 2007037035 | 4/2007 |
| WO | 2007/117608 | 10/2007 |
| WO | 2008/140884 | 11/2008 |
| WO | 2010/006665 | 1/2010 |
| WO | 2013/060825 | 5/2013 |

* cited by examiner

LUMINAIRES AND REFLECTOR MODULES

FIELD OF THE DISCLOSURE

The present disclosure is directed generally to a luminaire for casting light over a desired area. More particularly the present disclosure is directed to a luminaire having a reflector to guide light from a plurality of light sources to cast light over an area. The reflector preferably comprises a baseplate and individual reflectors extending integrally from the base plate adjacent one or more of the plurality of light sources.

BACKGROUND OF THE DISCLOSURE

There is a need for a reflector module of the type described herein.

SUMMARY OF THE DISCLOSURE

A luminaire is disclosed comprising a first row of light sources extending in the X-direction of the luminaire and comprising a first light source and a second light source, a second row of light sources extending in the X-direction of the luminaire and comprising a third light source and a fourth light source, the second row of light sources displaced in the Y-direction from the first row of light sources; a reflector module, the reflector module comprising a base plate, the base plate defining a first light source aperture associated with the first light source, a second light source aperture associated with the second light source, and a first reflector aperture between the first light source aperture and the second light source aperture, the first reflector aperture defining a perimeter, a first light source forward reflector integrally extending from the reflector aperture perimeter adjacent the first light source aperture, the first light source forward reflector comprised of material displaced from the base plate to define the first reflector aperture, a second light source rear reflector integrally extending from the reflector aperture perimeter adjacent the second light source aperture, the second light source rear reflector comprised of material displaced from the base plate to define the first reflector aperture, a third light source aperture defined in the base plate and associated with the third light source, a fourth light source aperture defined in the base plate and associated with the fourth light source, and a second reflector aperture defined in the base plate between the third light source aperture and the fourth light source aperture, the second reflector aperture defining a perimeter, a third light source forward reflector integrally extending from the second reflector aperture perimeter adjacent the third light source aperture, the third light source forward reflector comprised of material displaced from the base plate to define the second reflector aperture; and a fourth light source rear reflector integrally extending from the second reflector aperture perimeter adjacent the fourth light source aperture, the fourth light source rear reflector comprised of material displaced from the base plate to define the second reflector aperture; wherein the first light source forward reflector, the second light source rear reflector, the third light source forward reflector, the fourth light source rear reflector are each individual reflectors. In one exemplary embodiment, the base plate is comprised of sheet metal. In one exemplary embodiment, the first light source comprises a light emitting diode. In one exemplary embodiment, the luminaire is configured to produce a light distribution approximating an IESNA Type IV light distribution. In one exemplary embodiment, the luminaire is configured to produce a light distribution approximating an IESNA Type V light distribution.

Another luminaire is disclosed comprising a first row of light sources extending in the X-direction of the luminaire and comprising a first light source and a second light source, a second row of light sources extending in the X-direction of the luminaire and comprising a third light source and a fourth light source, the second row of light sources displaced in the Y-direction from the first row of light sources, a third row of light sources extending in the Y-direction of the luminaire and comprising a fifth light source and a sixth light source, a fourth row of light sources extending in the Y-direction of the luminaire and comprising a seventh light source and a eighth light source, the fourth row of light sources displaced in the X-direction from the first row of light sources, a reflector module, the reflector module comprising a base plate, the base plate defining a first light source aperture associated with the first light source, a second light source aperture associated with the second light source, and a first reflector aperture between the first light source aperture and the second light source aperture, the first reflector aperture defining a perimeter, a first light source forward reflector integrally extending from the first reflector aperture perimeter adjacent the first light source aperture, the first light source forward reflector comprised of material displaced from the base plate to define the first reflector aperture, a second light source rear reflector integrally extending from the first reflector aperture perimeter adjacent the second light source aperture, the second light source rear reflector comprised of material displaced from the base plate to define the first reflector aperture, a third light source aperture defined in the base plate and associated with the third light source, a fourth light source aperture defined in the base plate and associated with the fourth light source, and a second reflector aperture defined in the base plate between the third light source aperture and the fourth light source aperture, the second reflector aperture defining a perimeter, a third light source forward reflector integrally extending from the second reflector aperture perimeter adjacent the third light source aperture, the third light source forward reflector comprised of material displaced from the base plate to define the second reflector aperture, a fourth light source rear reflector integrally extending from the second reflector aperture perimeter adjacent the fourth light source aperture, the fourth light source rear reflector comprised of material displaced from the base plate to define the second reflector aperture, wherein the first light source forward reflector, the second light source rear reflector, the third light source forward reflector, the fourth light source rear reflector are each individual reflectors, the base plate defining a fifth light source aperture associated with the fifth light source, a sixth light source aperture associated with the sixth light source, and a third reflector aperture between the fifth light source aperture and the sixth light source aperture, the third reflector aperture defining a perimeter, a fifth light source forward reflector integrally extending from the third reflector aperture perimeter adjacent the first light source aperture, the fifth light source forward reflector comprised of material displaced from the base plate to define the third reflector aperture, a sixth light source rear reflector integrally extending from the third reflector aperture perimeter adjacent the sixth light source aperture, the sixth light source rear reflector comprised of material displaced from the base plate to define the third reflector aperture, a seventh light source aperture defined in the base plate and associated with the seventh light source, an eighth light source aperture defined in the base plate and associated with the eighth light source, and a fourth reflector aperture defined in the base plate between the seventh light source aperture and the eighth light source aperture, the fourth reflector aperture defining a perimeter, a seventh light source forward reflector integrally extending from the fourth reflector aperture perimeter adjacent the seventh light source aperture, the seventh light source forward reflector comprised of material displaced from the base plate to define the fourth reflector aperture, and an eighth light source rear reflector integrally extending from the eighth reflector aperture perimeter adjacent the eighth light source aperture, the eighth light source rear reflector comprised of material displaced from the base plate to define the fourth reflector aperture, wherein the fifth light source forward reflector, the sixth light source rear reflector, the seventh light source forward reflector, the eighth light source rear reflector are each individual reflectors. In one exemplary embodiment, the base plate is comprised of sheet metal. In one exemplary embodiment, the first light source comprises a light emitting diode. In one exemplary embodiment, the luminaire is configured to produce a light distribution approximating an IESNA Type V light distribution.

A further luminaire is disclosed comprising an array of light sources, a reflector module to be associated with the array of light sources to form a light distribution, the reflector module comprising a base plate, a first sector of reflectors comprising a first reflector extending integrally from the base plate adjacent a first light source aperture defined in the base plate and associated with a first light source of the array of light sources, the first reflector defining a front facing the first light source aperture, and the first reflector not extending adjacent to any light source aperture other than the first light source aperture, a second reflector extending integrally from the base plate adjacent a second light source aperture defined in the base plate and associated with a second light source of the array of light sources, the second reflector defining a front facing the second light source aperture, and the second reflector not extending to any light source aperture other than the second light source aperture, the front of the first reflector and the front of the second reflector facing in an X-direction of the luminaire, a second sector of reflectors comprising, a third reflector extending integrally from the base plate adjacent a third light source aperture defined in the base plate and associated with a third light source of the array of light sources, the third reflector defining a front facing the third light source aperture, and the third reflector not extending adjacent to any light source aperture other than the third light source aperture, a fourth reflector extending integrally from the base plate adjacent a fourth light source aperture defined in the base plate and associated with a fourth light source of the array of light sources, the fourth reflector defining a front facing the fourth light source aperture, and the fourth reflector not extending adjacent to any light source aperture other than the fourth light source aperture, and the front of the third reflector and the front of the fourth reflector facing in a Y-direction of the luminaire. In one exemplary embodiment, the light sources are light emitting diodes. In one exemplary embodiment, the luminaire is configured to produce a light distribution approximating an IESNA Type V light distribution. In one exemplary embodiment, the first and second light sources are aligned in the Y-direction. In one exemplary embodiment, third and fourth light sources are aligned in the X-direction. In one exemplary embodiment, a third sector of reflectors comprises a fifth reflector extending integrally from the base plate adjacent a fifth light source aperture defined in the base plate and associated with a fifth light source of the array of light sources, the fifth reflector defining a front facing the fifth light source, and the fifth reflector not extending adjacent to any light source other than the fifth light source, a sixth reflector extending integrally from the base plate adjacent a sixth light source aperture defined in the base plate and associated with a sixth light source of the array of light sources, the sixth reflector defining a front facing the sixth light source, and the sixth reflector not extending adjacent to any light source other than the sixth light source, and the front of the fifth reflector and the front of the sixth reflector facing in a −X-direction of the luminaire. In one exemplary embodiment, the luminaire comprises a third sector of reflectors comprising a fifth reflector extending integrally from the base plate adjacent a fifth light source aperture defined in the base plate and associated with a fifth light source of the array of light sources, the fifth reflector defining a front facing the fifth light source, and the fifth reflector not extending adjacent to any light source other than the fifth light source, a sixth reflector extending integrally from the base plate adjacent a sixth light source aperture defined in the base plate and associated with a sixth light source of the array of light sources, the sixth reflector defining a front facing the sixth light source, and the sixth reflector not extending adjacent to any light source other than the sixth light source, and the front of the fifth reflector and the front of the sixth reflector facing in a −X-direction of the luminaire. In one exemplary embodiment, a fourth sector of reflectors comprises a seventh reflector extending integrally from the base plate adjacent a seventh light source aperture defined in the base plate and associated with a seventh light source of the array of light sources, the seventh reflector defining a front facing the seventh light source, and the seventh reflector not extending adjacent to any light source other than the seventh light source, an eighth reflector extending integrally from the base plate adjacent an eighth light source aperture defined in the base plate and associated with an eighth light source of the array of light sources, the eighth reflector defining a front facing the eighth light source, and the eighth reflector not extending adjacent to any light source other than the eighth light source, and the front of the seventh reflector and the front of the eighth reflector facing in a −Y-direction of the luminaire.

Yet another luminaire is disclosed comprising a first light source and a second light source, the second light source being forward of the first light source, a reflector module, the reflector module comprising a base plate having a reflective surface, the base plate defining a first light source aperture associated with the first light source, a second light source aperture associated with the second light source, and a second light source rear reflector integrally extending adjacent to the second light source aperture, the second light source rear reflector defining a rear face facing the first light source and a front face facing the second light source, the rear face of the second light source rear reflector at least partially covered with a light absorbing material. In one exemplary embodiment, the base plate defines a reflector aperture between the first light source aperture and the second light source aperture, the reflector aperture defining a perimeter. In one exemplary embodiment, the luminaire further comprises a first light source forward reflector integrally extending from the reflector aperture perimeter adjacent the first light source aperture. In one exemplary embodiment, the first light source forward reflector is comprised of material removed from the base plate to define the reflector aperture. In one exemplary embodiment, the second light source rear reflector is comprised of material removed from the base plate to define the reflector aperture. In one exemplary embodiment, the light absorbing material is ink, paint or lacquer. In one exemplary embodiment, the light absorbing material is black. In one exemplary embodiment, the luminaire is configured to produce a light distribution approximating an IESNA Type IV light distribution. In one exemplary embodiment, the reflective surface covers the entire baseplate.

Yet another luminaire is disclosed as configured to form a light distribution casting light in at least an X-direction of the luminaire and minimizing light cast in the −X direction of the luminaire, the luminaire comprising an array of light sources, a reflector module to be associated with the array of light sources to produce the light distribution, the reflector module comprising a base plate, a first sector of reflectors comprising a first reflector extending integrally from the base plate adjacent a first light source aperture defined in the base plate and associated with a first light source of the array of light sources, the first reflector defining a front facing the first light source and a rear facing the opposite direction, the rear face of the first reflector at least partially covered with a light absorbing material, a second reflector extending integrally from the base plate adjacent a second light source aperture defined in the base plate and associated with a second light source of the array of light sources, the second reflector defining a front facing the second light source and a rear facing the opposite direction, the rear face of the second reflector at least partially covered with a light absorbing material, the front of the first reflector and the front of the second reflector facing in an X-direction of the luminaire, a second sector of reflectors comprising a third reflector extending integrally from the base plate adjacent a third light source aperture defined in the base plate and associated with a third light source of the array of light sources, the third reflector defining a front facing the third light source and a rear facing the opposite direction, the rear face of the third reflector not having any light absorbing material, a fourth reflector extending integrally from the base plate adjacent a fourth light source aperture defined in the base plate and associated with a fourth light source of the array of light sources, the fourth reflector defining a front facing the fourth light source and a rear facing the opposite direction, the rear face of the third reflector not having any light absorbing material; and the front of the third reflector and the front of the fourth reflector facing in a Y-direction of the luminaire. In one exemplary embodiment, the light sources are light emitting diodes. In one exemplary embodiment, the luminaire is configured to produce a light distribution approximating an IESNA Type V light distribution. In one exemplary embodiment, the first and second light sources are aligned in the Y-direction. In one exemplary embodiment, the third and fourth light sources are aligned in the X-direction. In one exemplary embodiment, the first reflector not extending adjacent to any light source other than the first light source, the second reflector not extending adjacent to any light source aperture other than the second light source, the third reflector not extending adjacent to any light source other than the third light source, and the fourth reflector not extending adjacent to any light source other than the fourth light source.

Yet a further luminaire is disclosed as being configured to form a light distribution casting light in at least an X-direction of the luminaire and minimizing light cast in the −X direction of the luminaire, the luminaire comprises an array of light sources, a reflector module to be associated with the array of light sources to produce the light distribution, the reflector module comprising a base plate defining an upper surface and a lower surface, the base plate upper surface being specular, a first reflector extending integrally and individually from the base plate adjacent a first light source aperture defined in the base plate and associated with a first light source of the array of light sources, the first reflector defining a front facing the first light source in an X-direction of the luminaire and a rear facing the opposite direction, the rear of the first reflector at least partially covered with a light absorbing material. In one exemplary embodiment, the luminaire further comprises a second reflector extending integrally from the base plate adjacent a second light source aperture defined in the base plate and associated with a second light source of the array of light sources, the second reflector defining a front facing the second light source in the X-direction of the luminaire and a rear facing the opposite direction, the rear face of the second reflector at least partially covered with a light absorbing material. In one exemplary embodiment the light sources are light emitting diodes. In one exemplary embodiment, the luminaire is configured to produce a light distribution approximating an IESNA Type IV light distribution. In one exemplary embodiment, the first and second light sources are aligned in the Y-direction.

BRIEF DESCRIPTION OF THE DRAWINGS

Aspects and embodiments of the present disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1A:
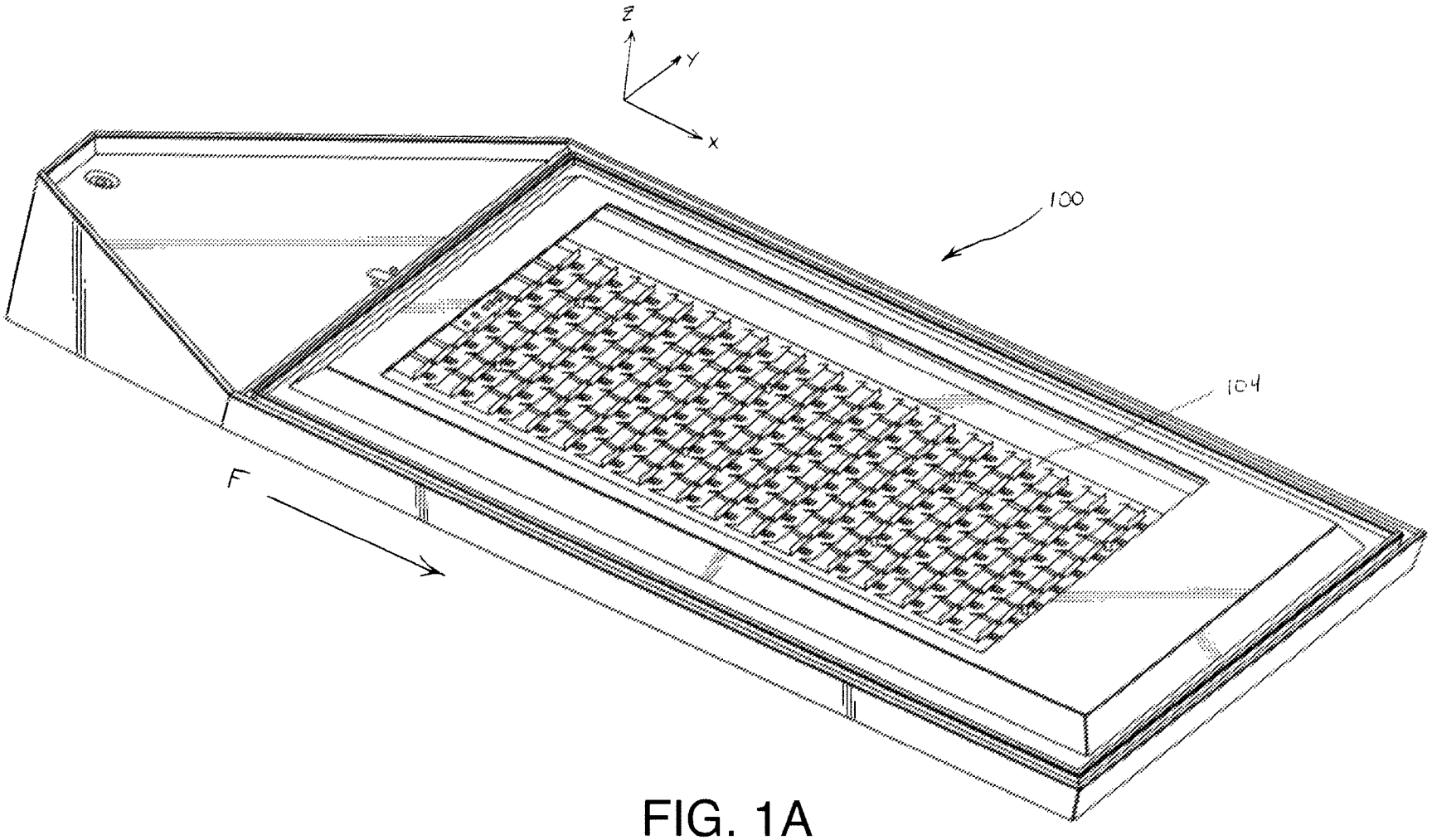
FIG. 1A depicts a luminaire in accordance with the present invention.

The embodiments depicted in the drawing are merely illustrative. Variations of the embodiments shown in the drawings, including embodiments described herein, but not depicted in the drawings, may be envisioned and practiced within the scope of the present disclosure.

DETAILED DESCRIPTION

Aspects and embodiments of the present disclosure provide luminaires and elements thereof. Luminaires according to the present disclosure can be used for new installations or to replace existing luminaires or elements thereof. Such luminaires and elements can afford more accurate light distribution and lower costs, offering reduced energy and maintenance as well as reduced assembly costs when compared to existing techniques. Such luminaires and elements also offer increased versatility, and thus efficiencies, to manufacturers lowering manufacturing and inventory costs.

While the disclosed embodiments use light emitting diodes ("LEDs") as light sources, other light sources now know or hereafter developed may be used in addition to LEDs or instead of LEDs within the scope of the present disclosure. By way of example only, other light sources such as plasma light sources may be used. Further, the term "LEDs" is intended to refer to all types of light emitting diodes including organic light emitting diodes ("OLEDs").

FIG. 1A depicts a perspective view of a luminaire 100, in accordance with the present disclosure comprising a plurality of light sources 102 (depicted as LEDs) associated with one embodiment of a reflector module 104 of the disclosure. The luminaire 100 is applicable to any application that would benefit from area lighting. By way of non-limiting example, the luminaire 100 and elements thereof depicted and/or described herein are applicable for indoor or outdoor area lighting. Lighting of parking lots, garages, roadways and warehouses are, among others, presently contemplated.

The reflector module 104 has a base plate 106 defining a lowermost plane of the reflector module 104. Although the base plate 106 is depicted as planar, it may have non-planar forms without departing from the scope of this disclosure. The terms "lower", "upper", "forward" and "rear" (including all their forms, such as "lowermost" "uppermost," etc.) are used herein to denote relative spatial relationships of the various elements of the invention and do not represent absolute requirements of any embodiment. For example, the earlier reference to the base plate 106 defining the lowermost plane of the reflector module 104 in no way requires that the base plate 106 be the lowermost portion of the reflector module 104 when the luminaire 100 is installed. To the contrary, it is anticipated that the luminaire 100 will most commonly be installed with the light sources 102 directed downward such that the base plate 106 will be the uppermost portion of the reflector module 104 after installation.

Figure 1B:
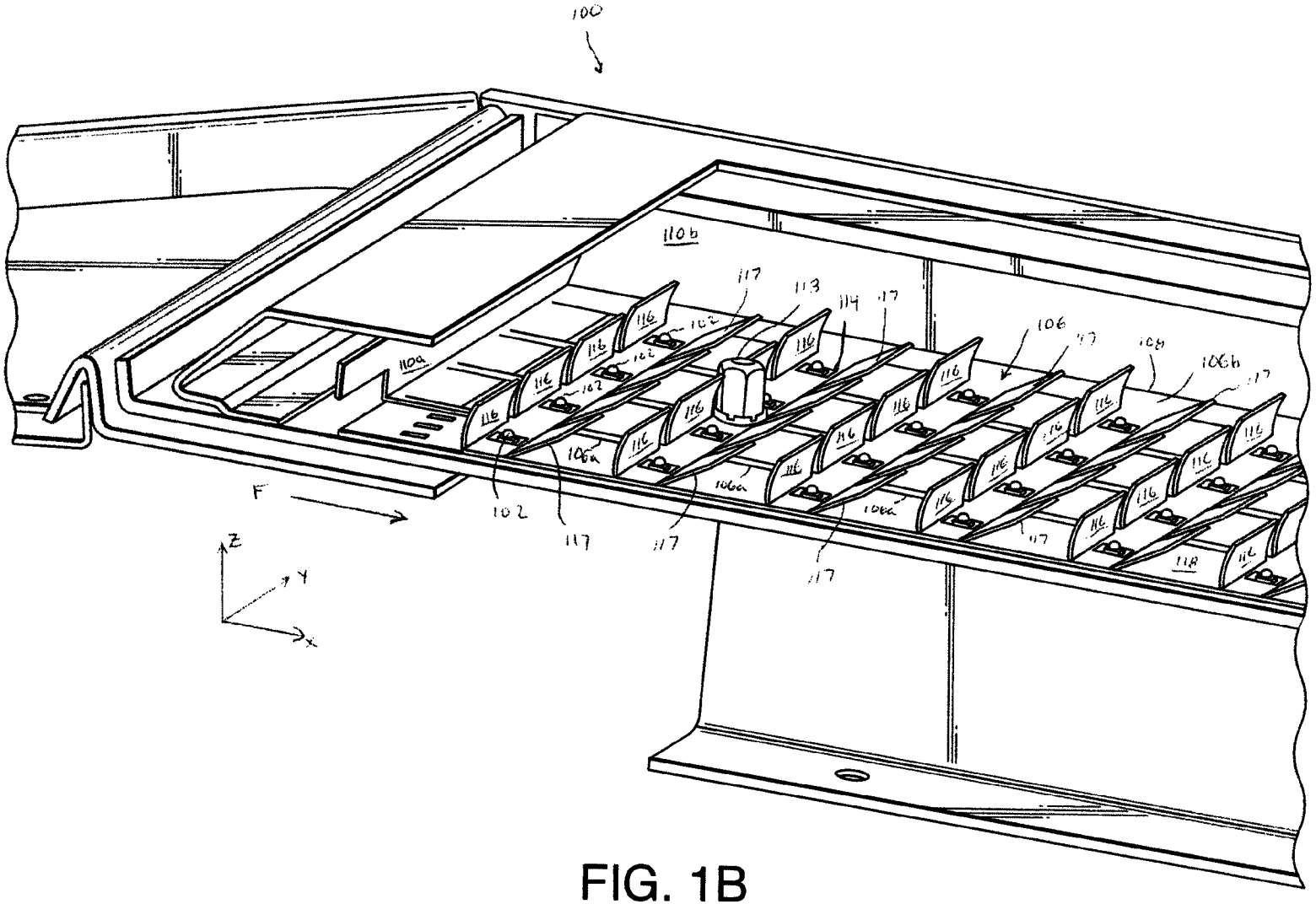
FIG. 1B depicts a cross-section taken through a portion of the luminaire depicted in FIG. 1A.
Figure 2:
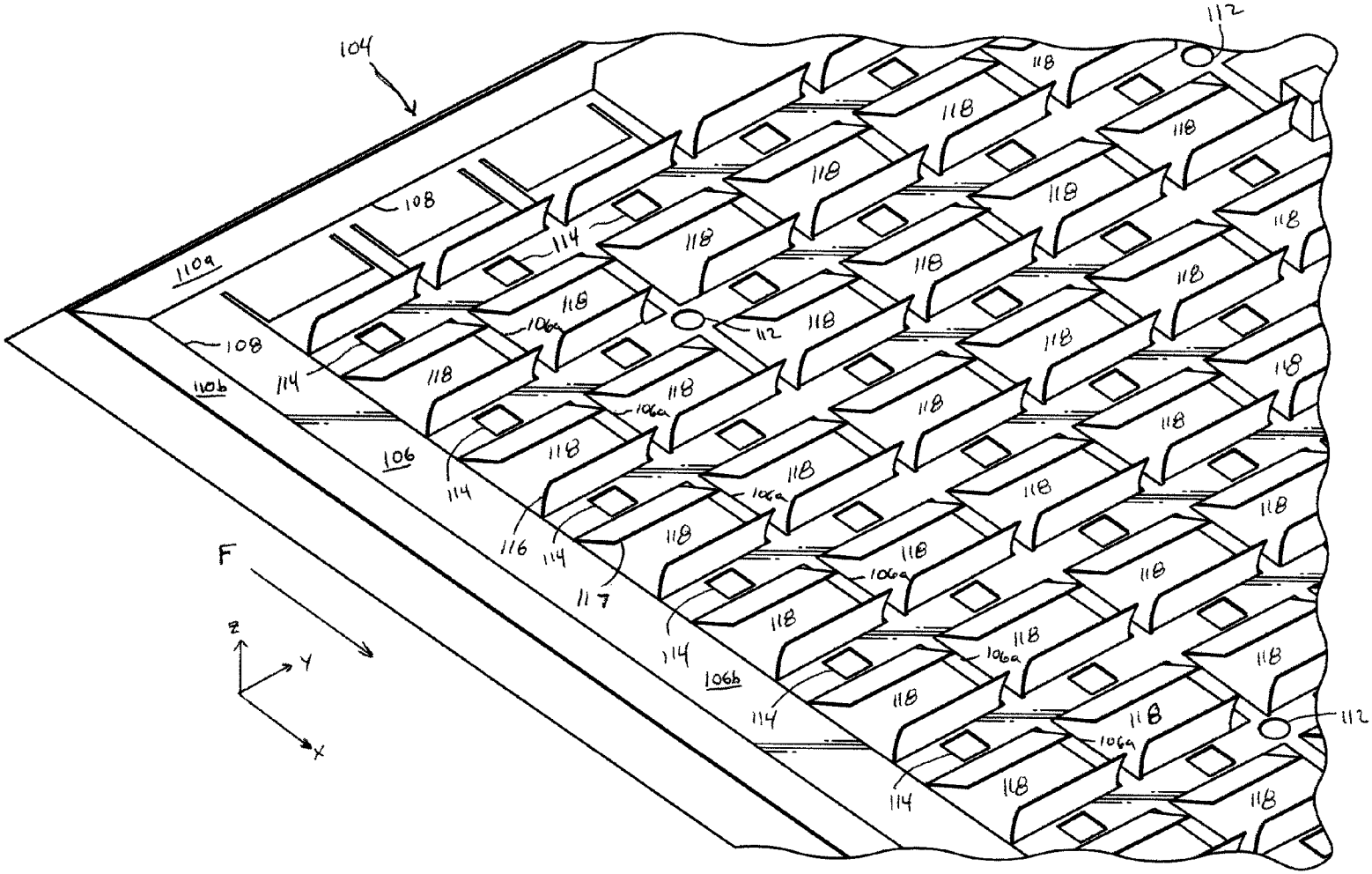
FIG. 2 depicts a front-side perspective view of a portion of the reflector module depicted in the luminaire in FIG. 1A.
Figure 3:
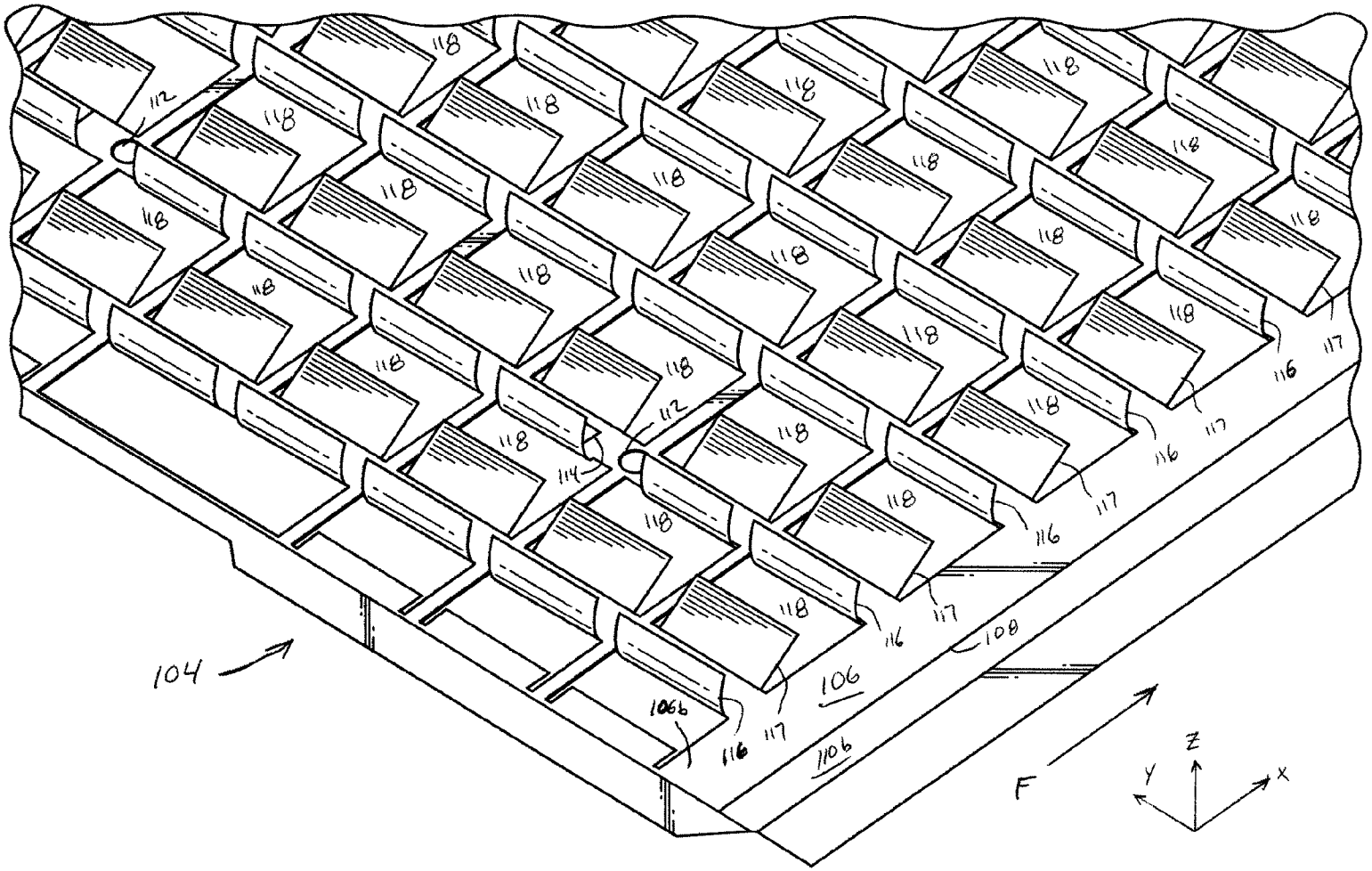
FIG. 3 depicts a rear-side perspective view of the reflector module depicted in FIG. 2.

As best depicted in FIGS. 1B and 2, the base plate 106 defines an outer perimeter 108. An outer perimeter reflector 110 optionally extends from each edge of the base plate outer perimeter 108. In the depicted embodiments, the base plate outer perimeter 108 defines a rectangle with four sides. Any other shape base plate outer perimeter 108 is contemplated as consistent with the disclosed invention. The outer perimeter reflector 110 comprises forward and rearward outer perimeter reflectors 110*a* extending from the forward and rearward edges of the outer perimeter 108. The forward and rearward outer perimeter reflectors 110*a* are depicted as extending perpendicular to the base plate 106, but other angles are also contemplated as consistent with the invention. The outer perimeter reflector 110 also comprises lateral outer perimeter reflectors 110*b* extending from the lateral edges of the outer perimeter 108, extending from the base plate 106 at an angle to the base plate 106. The outer perimeter reflectors 110 reflect light out of the luminaire 100 and preferably extend some or all of the way between the base plate 106 and the lens or exit from the luminaire 100 in order to prevent, or minimize, light from getting lost in the luminaire 100.

The reflector module 104 is associated with the luminaire 100 in any manner now known or hereafter developed. For example, the base plate 106 could be secured to a portion of the luminaire 100. Alternatively, outer perimeter reflectors 110 could be secured to the luminaire 100. In one embodiment, the base plate 106 is secured to the luminaire by locating the base plate 106 against a circuit board populated with the light sources 102 with the base plate 106 defining securing apertures 112 located over threaded posts (not depicted) and threaded nuts (e.g. nut 113 depicted in FIG. 1B) holding the base plate 106 against the circuit board.

The base plate 106 of the reflector module 104 defines a plurality of light source apertures 114. In the depicted embodiments, the light source apertures are arranged in an array of rows and columns, but the disclosure may apply to any other configuration as well. In the depicted embodiments of the reflector module 104, 104', 104" the light source apertures 114 are of a sufficient number to be associated one each with the light sources 102. It is contemplated, however, that fewer light source apertures than light sources 102 may be defined by enlarging one or more of the light source apertures to accommodate more than one light source 102. Yet another alternative embodiment is contemplated in which a greater number of light source apertures than light sources 102 are defined and some light source apertures are not associated with a light source 102. Such an embodiment would be useful to provide a reflector module that can be associated with two or more different arrangements or numbers of light sources 102 so as to provide different light distribution and/or different lumen output.

The base plate defines an upper surface 106*b* and a lower surface 106*c*. A portion of the base plate 106 to the rearward side of each light source aperture 114 extends upward from the plane of the base plate 106 to define a rear reflector 116 with a face, comprised of what was formerly the base plate upper surface 106*b*, facing the adjacent light source 102. A portion of the base plate 106 to the forward side of each light source aperture 114 extends upward from the plane of the base plate 106 to define a forward reflector 117 with a face, comprised of what was formerly the base plate upper surface 106*b*, facing the same light source 102. In the embodiments of the reflector module of the instant disclosure shown as reflector modules 104 and 104', a rear reflector 116 and a forward reflector 117 extend adjacent to each light source aperture 114. However, rear reflectors 116 and forward reflectors 117 may extend adjacent to fewer than all light source apertures 114 and varying the number and distribution of these reflectors 116, 117 can vary the light distribution caused by the reflector module 104. Where two light source apertures 114 are adjacent to one another in the forward direction F, the removal of the forward reflector 117 from the rearmost of the two light source apertures and the removal of the rear reflector 116 of the forward-most of the two light source apertures leaves a reflector aperture 118 defined in the base plate 106 between the adjacent pair of light source apertures 114.

This reflector configuration can be perpetuated along any number of light source apertures aligned along the forward direction F. One example is depicted in FIG. 1A, which depicts the reflector module 104 having columns of sixteen light source apertures 114 aligned along the forward direction F, each having a rear reflector 116 and forward reflector 117 associated therewith. Furthermore, this reflector configuration can be perpetuated laterally (i.e. perpendicular to the forward direction F). One example is depicted in FIG. 1A, which depicts the reflector module 104 having rows of eight light source apertures 114 aligned perpendicular to the forward direction F, each having a rear reflector 116 and forward reflector 117 associated therewith.

Figure 5B:
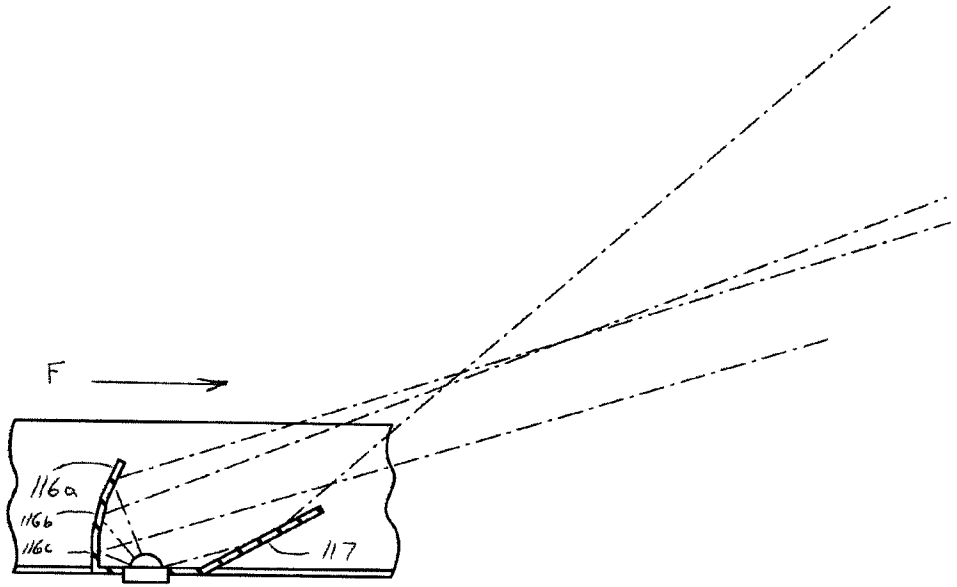
FIG. 5B depicts the subject matter of FIG. 5A with light ray traces.
Figure 5A:
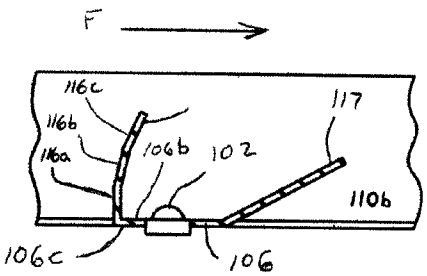
FIG. 5A depicts a cross-sectional view of a light source and associated portions of the reflector module of FIG. 2.

The rear reflectors 116 and forward reflectors 117 shown in FIGS. 1A, 1B, 1C, 2 and 3 are all of the configurations shown in FIGS. 5A and 5B. It is within the teachings of the present disclosure, however, to vary one or more of the rear reflectors 116 and/or forward reflectors 117 as desired to achieve a desired light distribution. The rear reflectors 116 and forward reflectors 117 shown in FIGS. 1A, 1B, 1C, 2 and 3 are all oriented such that each forward reflector 117 is located on the forward F side of the associated light source aperture 114 and each rear reflector 116 is located on the opposite side of the light source aperture 114 from the forward reflector 117 (i.e. the rearward side).

Figure 1C:
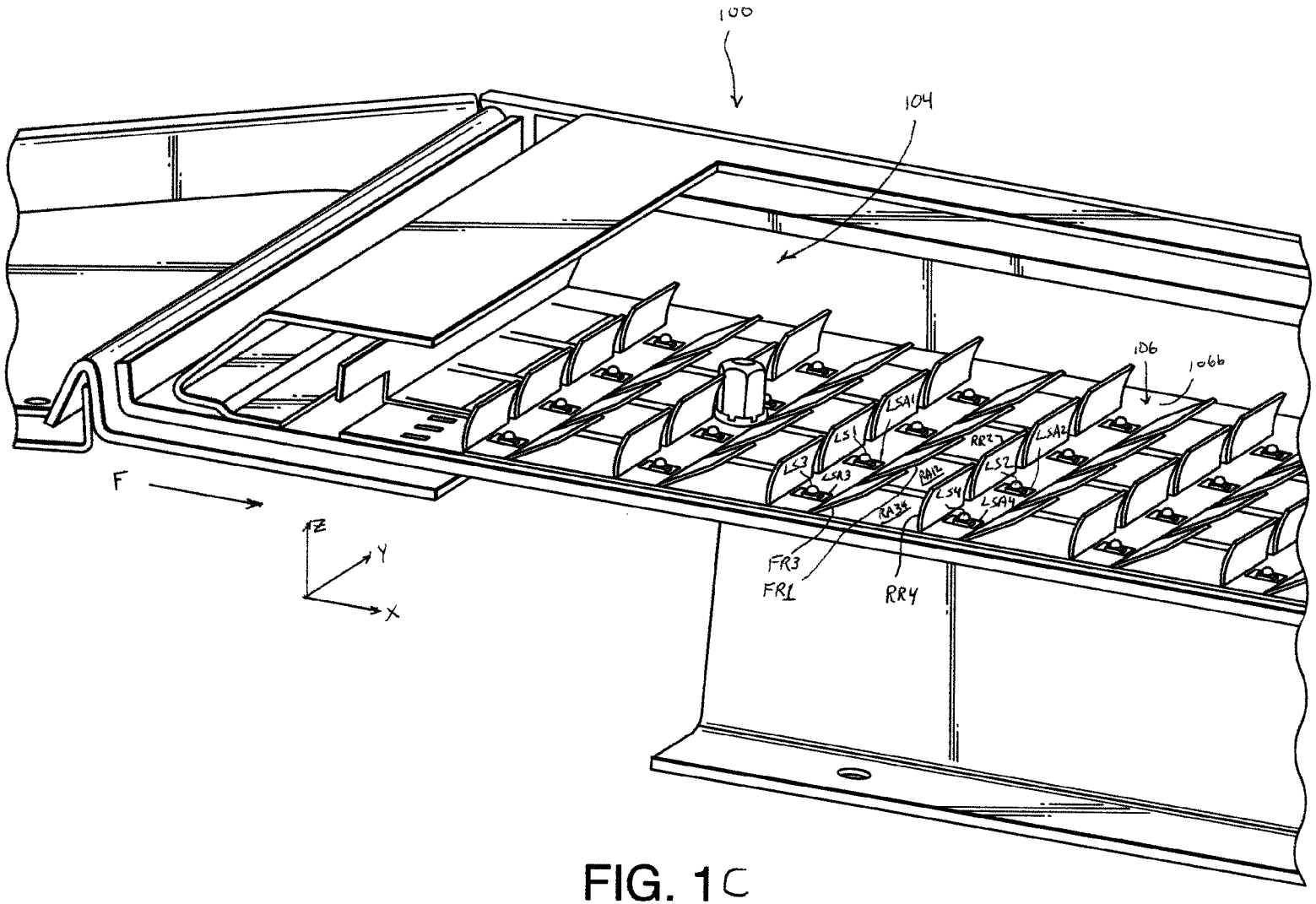
FIG. 1C depicts the same cross-section of FIG. 1B.

One embodiment of the luminaire 100 and reflector module 104 of the present disclosure is described with reference to FIG. 1C in which the reflector module 104 is associated with a first row of the light sources 102 extending in the forward direction F of the luminaire 100, which is the X-direction of the luminaire, and comprising a first light source LS1 and a second light source LS2 and a second row of light sources extending in the X-direction of the luminaire and comprising a third light source LS3 and a fourth light source LS4, the second row of light sources displaced in the Y-direction from the first row of light sources. The reflector module 104 comprises the base plate 106 in which the first of the light source aperture LSA1 is defined for association with the first light source LS1 and the second light source aperture LSA2 is defined for association with the second light source LS2. The first reflector aperture RA12 is defined between the first light source aperture LSA1 and the second light source aperture LSA2, the first reflector aperture defining a perimeter. A first light source forward reflector FR1 integrally extends from the first reflector aperture RA12 perimeter adjacent the first light source aperture LSA1, the first light source forward reflector FR1 is comprised of material displaced from the base plate 106 to define the first reflector aperture RA12. A second light source rear reflector RR2 integrally extends from the reflector aperture RA12 perimeter adjacent the second light source aperture LSA2, the second light source rear reflector RR2 is comprised of material displaced from the base plate 106 to define the first reflector aperture RA12. A third light source aperture LSA3 is defined in the base plate 106 and associated with the third light source LS3, a fourth light source aperture LSA4 is defined in the base plate 106 and associated with the fourth light source LS4, and a second reflector aperture RA34 is defined in the base plate 106 between the third light source aperture LSA3 and the fourth light source aperture LSA4, the second reflector aperture defining a perimeter. A third light source forward reflector FR3 integrally extends from the second reflector aperture RA34 perimeter adjacent the third light source aperture LSA3, the third light source forward reflector FR3 comprised of material displaced from the base plate 106 to define the second reflector aperture RA34. A fourth light source rear reflector RR4 integrally extends from the second reflector aperture RA34 perimeter adjacent the fourth light source aperture LSA4, the fourth light source rear reflector RR4 comprised of material displaced from the base plate 106 to define the second reflector aperture RA34. The first light source forward reflector FR1, the second light source rear reflector RR2, the third light source forward reflector FR3, the fourth light source rear reflector RR4 are each individual reflectors.

It is within the scope of this disclosure to define different sectors of the reflector module 104, each having their own associated forward direction F different from the forward direction F of one or more other sectors with the forward reflector 117 located on the forward F side of the light source aperture 114 and the rear reflector 116 on the opposite side of the light source aperture 114 from the forward reflector 117. The reflector module 104' depicted in FIGS. 6A-6B and discussed further below, is one example of such a reflector module.

In the reflector module 104 depicted in FIGS. 1A, 1B, 2 and 3, all rear reflectors 116 are identically configured and all forward reflectors 117 are identically configured. The configurations of rear reflectors 116 and forward reflectors 117 of this reflector module are depicted in FIGS. 5A and 5B. Other configurations are within the scope of this disclosure. FIG. 5A depicts the rear reflector 116 and forward reflector 117 without light ray traces, while FIG. 5B depicts the same rear reflector 116 and forward reflector 117 with exemplary light ray traces representative of light emitted from an exemplary LED (a Philips Luxeon TX L1T2-5070) used as the light source 102. In the exemplary embodiment depicted in FIG. 5A, the rear reflectors 116 of the reflector module 104 depicted in FIGS. 1A, 1B, 2 and 3 comprise three integral segments: a first segment 116*a*, a second segment 116*b*, and a third segment 116*c*. These three segments 116*a*, 116*b*, 116*c* are each approximately straight, but angled each with respect to the adjacent segment to approximate a curve. In one exemplary embodiment, the first segment 116*a* extends integrally from the base plate 106 for 0.105 inches at an angle of approximately 90 degrees to the base plate 106, the second segment 116*b* extends at an angle of approximately 13 degrees to the first segment 116*a* for a distance of 0.113 inches and the third segment 116*c* extends at an angle of approximately 12 degrees to the second segment 116*b* for a distance of 0.113 inches to a third segment distal end, which constitutes a distal end of the rear reflector 116. The length and angles between the segments 116*a-c* of the rear reflectors 116 approximate a curved reflector curved from the base plate 106 in the forward F direction. As depicted in FIG. 5B, the rear reflector 116 redirects light projected in the rearward direction from the light source 102 into the forward direction. The length and angles between the segments 116*a-c* of the rear reflectors 116 can be varied to adjust the resulting light distribution, as desired.

In the depicted exemplary embodiment, the forward reflector 117 extends approximately straight from, and integral with, the base plate 106 for 0.415 inches at an angle of approximately 41 degrees to the base plate 106. With the light sources 102 distributed at a pitch of approximately 1.125 inches, the light emitted from the light source 102 in generally the forward direction F will pass over the adjacent rearward reflector 116 without incident, either because it does not contact the either the rearward or forward reflectors 116, 117 or because it encounters the forward reflector 117 and is reflected at an angle to miss the adjacent rear reflector 116. Other numbers of reflector segments, other segment lengths and other angles between reflector segments are contemplated to redirect light as required to create the desired light distribution from the array of light sources.

In the depicted reflector module 104, light emitted from the light source 102 in generally the rearward direction will either pass in the generally Z direction of the luminaire 100 without encountering the reflector module 104 or will reflector off of the rear reflector 116. As discussed above, the segments 116*a-c* of the rear reflector 116 are configured so as to approximate a curve extending from the base plate 106 and curving up and in the forward direction F. As a result, light emitted from the light source 102 and light encountering the reflector module 104 is directed primarily in the X and Z directions of the luminaire 100. Light emitted laterally of the light source 102 (i.e. lateral to the forward direction F) will largely be unfettered by the reflector module 104.

Each rear reflector 116 extends from the baseplate 106 individually. That is, each rear reflector 116 is separate from each other rear reflector 116 and each forward reflector 117. Likewise, each forward reflector 117 extends from the baseplate 106 individually. That is, each forward reflector 117 is separate from each other forward reflector 117 and each rear reflector. Reflectors 116, 117 are connected to other reflectors 116, 117 only through the base plate 106. Moreover, each rear reflector 116 and forward reflector 117 extend individually adjacent to only one light source 102. In this way, the reflector module 104 of the present disclosure differs from prior art reflectors which had a single elongated rear reflector or forward reflector extending from the baseplate 106 adjacent a plurality of light sources. As a result, base plate runners 106*a* are left between adjacent reflector apertures 118. These base plate runners 106*a* provide extra rigidity to the reflector module. Moreover, creation of the rear reflectors 116 and forward reflectors 117 from material in the reflector apertures 118 rather than forming an entire row (e.g. an inverted V-shaped reflector row) from the base plate 106 also requires less material from which to form the baseplate 106.

Configuring each rear reflector 116 and forward reflector 117 to only be adjacent to a single light source 102 provides the reflector module 104 with flexibility to orient each rear reflector 116 and forward reflector 117 in any direction of the X-Y plane of the luminaire 100. For example, the exemplary reflector module 104 depicted in FIGS. 1A, 1B, 1C, 2 and 3 uses the previously described forward curved rear reflector 116 and straight forward reflector 117 with all rear and forward reflectors 116, 117 oriented in the same X-direction of the luminaire 100 to cast light generally in the forward F direction to approximate an IESNA Type IV light distribution. However, a slightly different or greatly different light distribution can be obtained by orienting one or more of the rear and forward reflectors 116, 117 in one or more different directions.

Figure 6A:
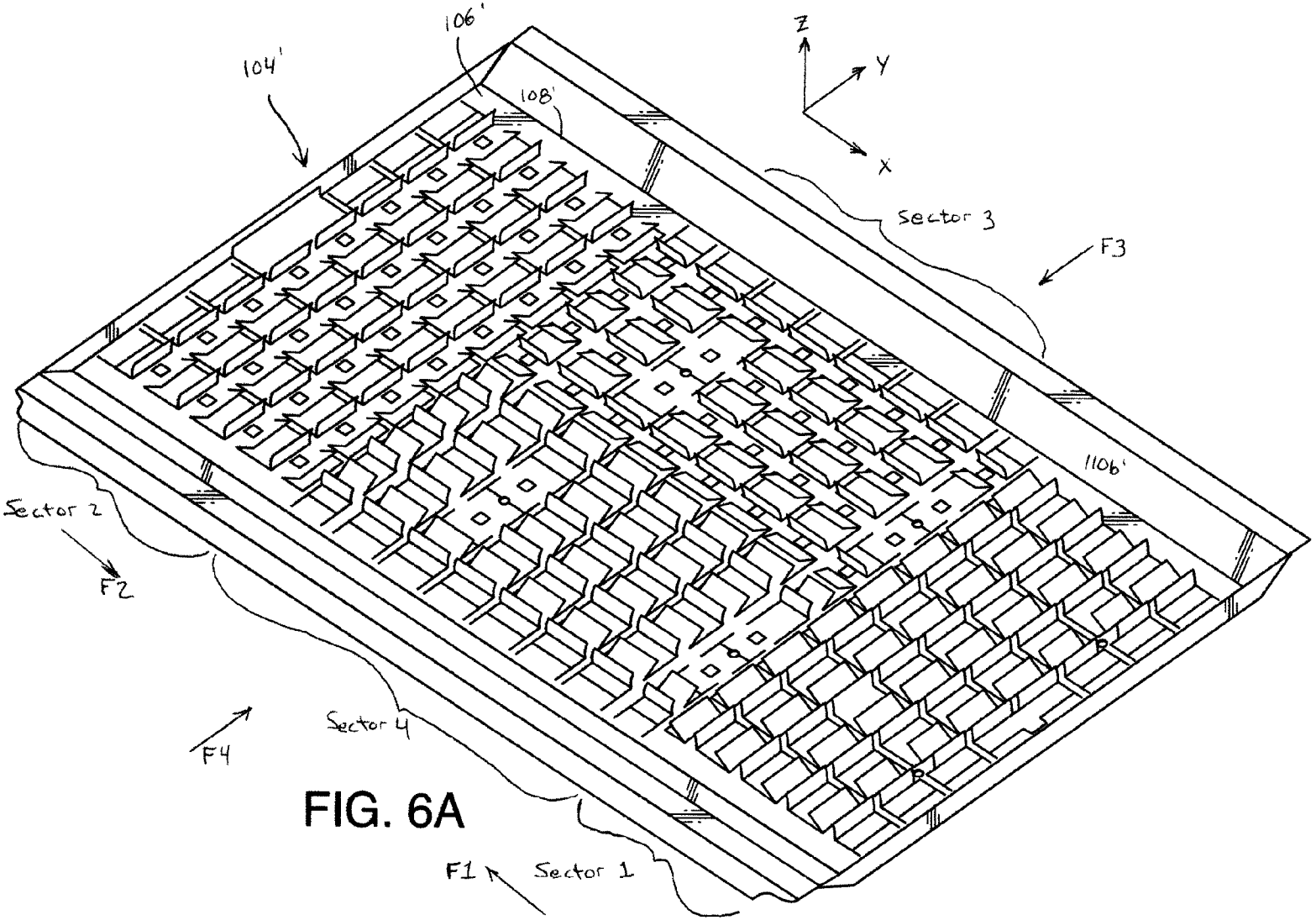
FIG. 6A depicts an alternative embodiment reflector module.
Figure 6B:
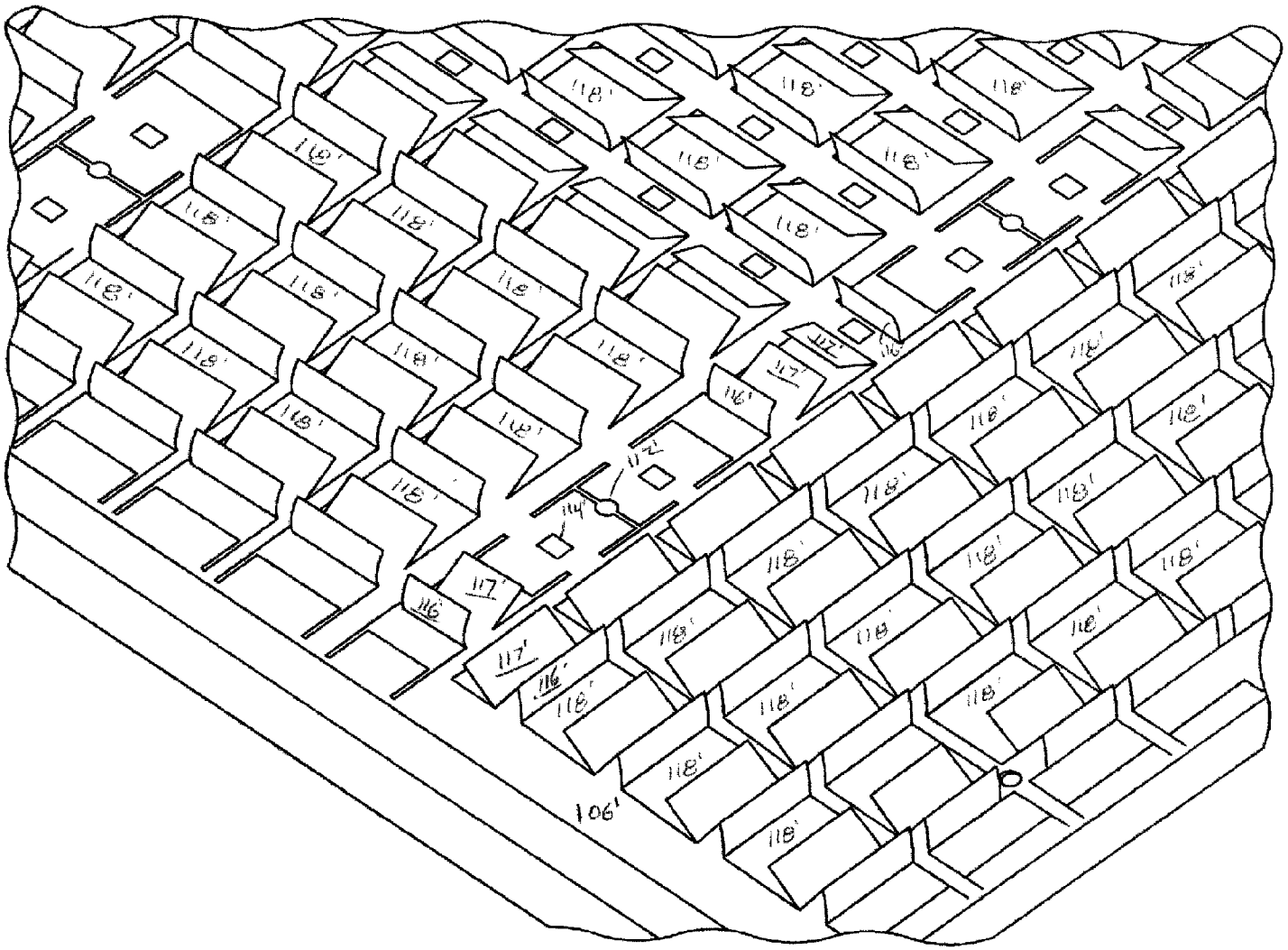
FIG. 6B depicts an enlarged view of one portion of the reflector module depicted in FIG. 6A.

The reflector module of FIGS. 6A-6B is one example of a reflector module 104' having one or more of the rear and forward reflectors 116, 117 oriented in different directions from other rear and forward reflectors 116, 117. The reflector module 104' comprises a base plate 106' having an outer perimeter 108' and defining securing apertures 112' and light source apertures 114'. Rear reflectors 116' and forward reflectors 117' are defined adjacent to each light source aperture 114' to redirect portions of the light emitted from a light source 102 (not depicted in FIGS. 6A-6B) located in the light source aperture 114'. Each rear reflector 116' extends integrally from the base plate 106' and is of the same configuration as rear reflectors 116 described above and each forward reflector 117' extends integrally from the base plate 106' and is of the same configuration as the forward reflectors 117 described above. The rear and forward reflectors 116', 117' are formed from base plate 106' material and adjacent rear and forward reflectors 116', 117' leave a reflector aperture 118' in the base plate 106'.

Unlike the reflector module 104 of FIGS. 1A, 1B, 2 and 3, the reflector module 104' of FIGS. 6A-6B orients some of the rear and forward reflectors 116', 117' in other than the X-direction. More specifically, the reflector module 104' of FIGS. 6A-6B orients some rear and forward reflectors 116', 117' in each of the X, Y, −X and −Y directions to approximate an IESNA Type V light distribution. Even more particularly, the reflector module 104' of FIGS. 6A-6B defines four sectors of reflectors 116', 117', each sector comprising a plurality of rear and forward reflectors 116', 117' all oriented in the same direction, but with the reflectors 116', 117' of each sector oriented in a different one of the X, Y, −X and −Y directions. As depicted in FIG. 6A, Sector 1 of reflector module 104' comprises an array of light source apertures 114' and associated rear and forward reflectors 116', 117' all oriented to have a forward direction F in the −X direction; Sector 2 of reflector module 104' comprises an array of light source apertures 114' and associated rear and forward reflectors 116', 117' all oriented to have a forward direction F in the X direction; Sector 3 of reflector module 104' comprises an array of light source apertures 114' and associated rear and forward reflectors 116', 117' all oriented to have a forward direction F in the -Y direction; and Sector 4 of reflector module 104' comprises an array of light source apertures 114' and associated rear and forward reflectors 116', 117' all oriented to have a forward direction F in the Y direction. In the depicted reflector module 104', each of Sectors 1-4 have the same number of light sources, but the number of light sources in each sector can vary to vary the resulting light distribution of the luminaire, as desired. The reflector module 104' depicted in FIGS. 6A-6B therefore provides a vastly different light distribution from the reflector module 104 depicted in FIGS. 1A, 1B, 2 and 3 when associated with the exact same light source array and with the exact same reflectors 116', 117' as the reflectors used in reflector module 104 by changing the orientation of some of the reflectors 116', 117'.

Figure 6C:
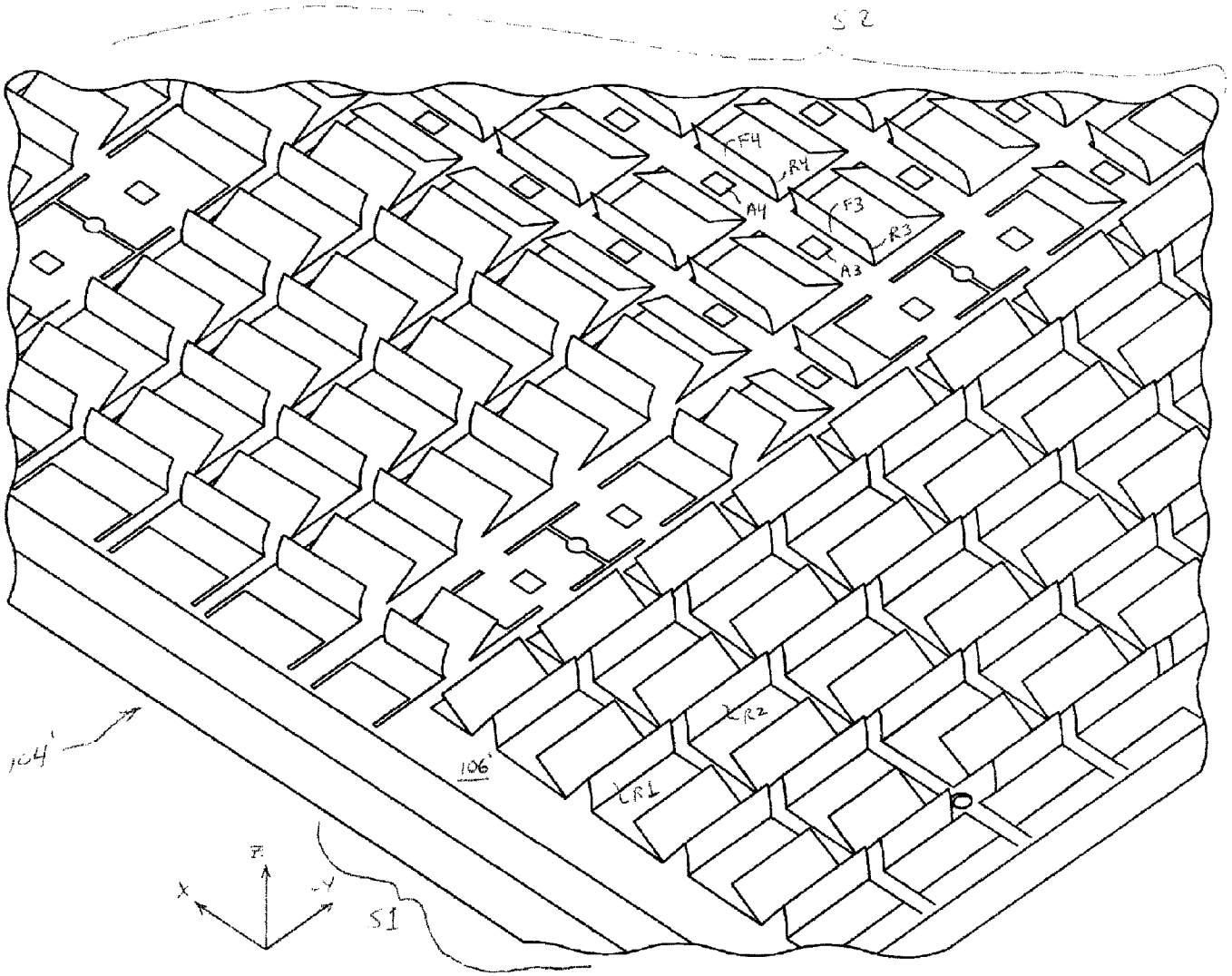
FIG. 6C depicts the enlarged view of FIG. 6B.

One embodiment of the present disclosure is described with reference to FIG. 6C which depicts a reflector module 104' for association with an array of light sources in a luminaire to form a light distribution. The reflector module 104' of FIG. 6C comprises base plate 106', a first sector 51 of reflectors which comprises a first reflector R1 extending integrally from the base plate adjacent a first light source aperture A1 (hidden from view by the first reflector R1) defined in the base plate and associated with a first light source of the array of light sources, the first reflector R1 defining a front F1 (opposite of the side shown) facing the first light source aperture A1, the first reflector R1 not extending adjacent to any light source aperture other than the first light source aperture A1. The first sector S1 of reflectors further comprises a second reflector R2 extending integrally from the base plate adjacent a second light source aperture A2 (hidden from view by the second reflector R2) defined in the base plate and associated with a second light source of the array of light sources, the second reflector R2 defining a front F2 (opposite of the side shown) facing the second light source aperture A2, and the second reflector R2 not extending to any light source aperture other than the second light source aperture A2. The front F1 of the first reflector R1 and the front F2 of the second reflector R2 both face in an X-direction of the luminaire, as shown. The reflector module 104' of FIG. 6C further comprises a second sector S2 of reflectors comprising a third reflector R3 extending integrally from the base plate adjacent a third light source aperture A3 defined in the base plate and associated with a third light source of the array of light sources, the third reflector R3 defining a front F3 facing the third light source aperture A3, and the third reflector R3 not extending adjacent to any light source aperture other than the third light source aperture A3. The second sector S2 of reflectors further comprises a fourth reflector R4 extending integrally from the base plate adjacent a fourth light source aperture A4 defined in the base plate and associated with a fourth light source of the array of light sources, the fourth reflector R4 defining a front F4 facing the fourth light source aperture A4, and the fourth reflector R4 not extending adjacent to any light source aperture other than the fourth light source aperture A4. The front F3 of the third reflector R3 and the front F4 of the fourth reflector R4 facing in a Y-direction of the luminaire.

Other configurations are also contemplated and virtually any desired light distribution can be provided from the array of light sources 102 depicted in the Figures or other light source arrays by varying the orientations of the reflectors. Fewer or more sectors of differently oriented reflectors 116, 117 may be employed. One or more sectors may use reflectors differently configured from the others to provide the desired light distribution. Because the reflectors associated with each light source are individual (i.e. not connected to reflectors of other light sources), each of the reflectors associated with each of the light sources can be configured and oriented as necessary to produce any desired light distribution.

Because of the flexibility afforded by using individual reflectors, a desired light distribution can be accomplished by varying the configuration and orientation of the reflectors adjacent to the light sources 102 to achieve a desired light distribution without use of additional reflective elements. For example, prior reflector modules often used additional reflective elements located over light source 102 and affixed to reflectors or other portions of the reflector module. Such additional reflective elements are not necessary with reflector modules of the present disclosure.

Further, because all of the reflectors 116, 117, 116', 117' are all integral to the base plate 106, 106' and because no additional reflective elements are necessary to accomplish any desired light distribution, the entire reflector module (104, 104' or other configuration) can be integrally formed of a single sheet of material 120. Forming the reflector module from a single integral sheet of material eliminates the need for any assembly operations to create the reflector module, thereby reducing the overall cost of the reflector module.

Figures 7A, 7B:
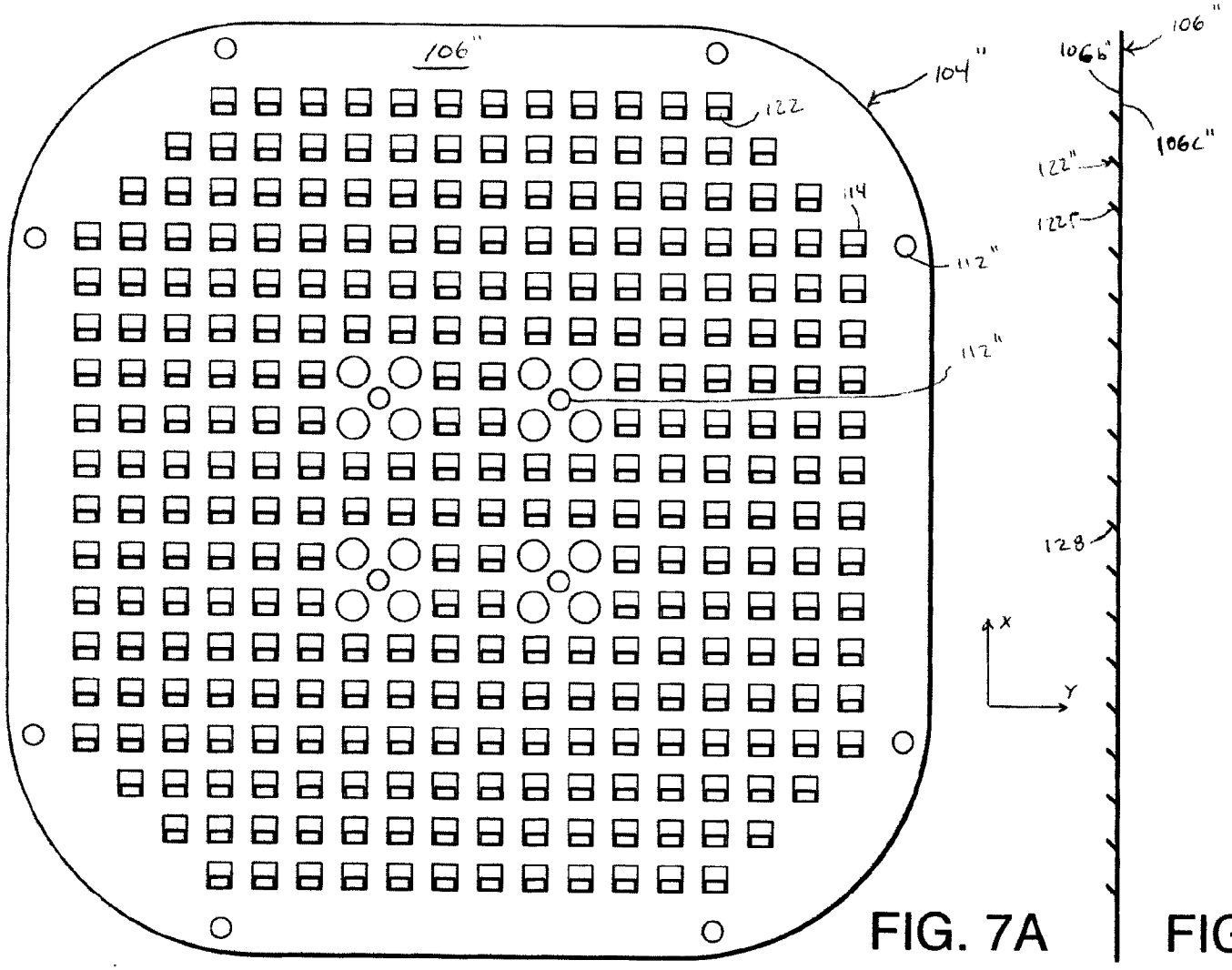
FIG. 7A depicts a top view of another alternative embodiment reflector module.
FIG. 7B depicts a side view of the reflector module depicted in FIG. 7A.
Figure 7C:
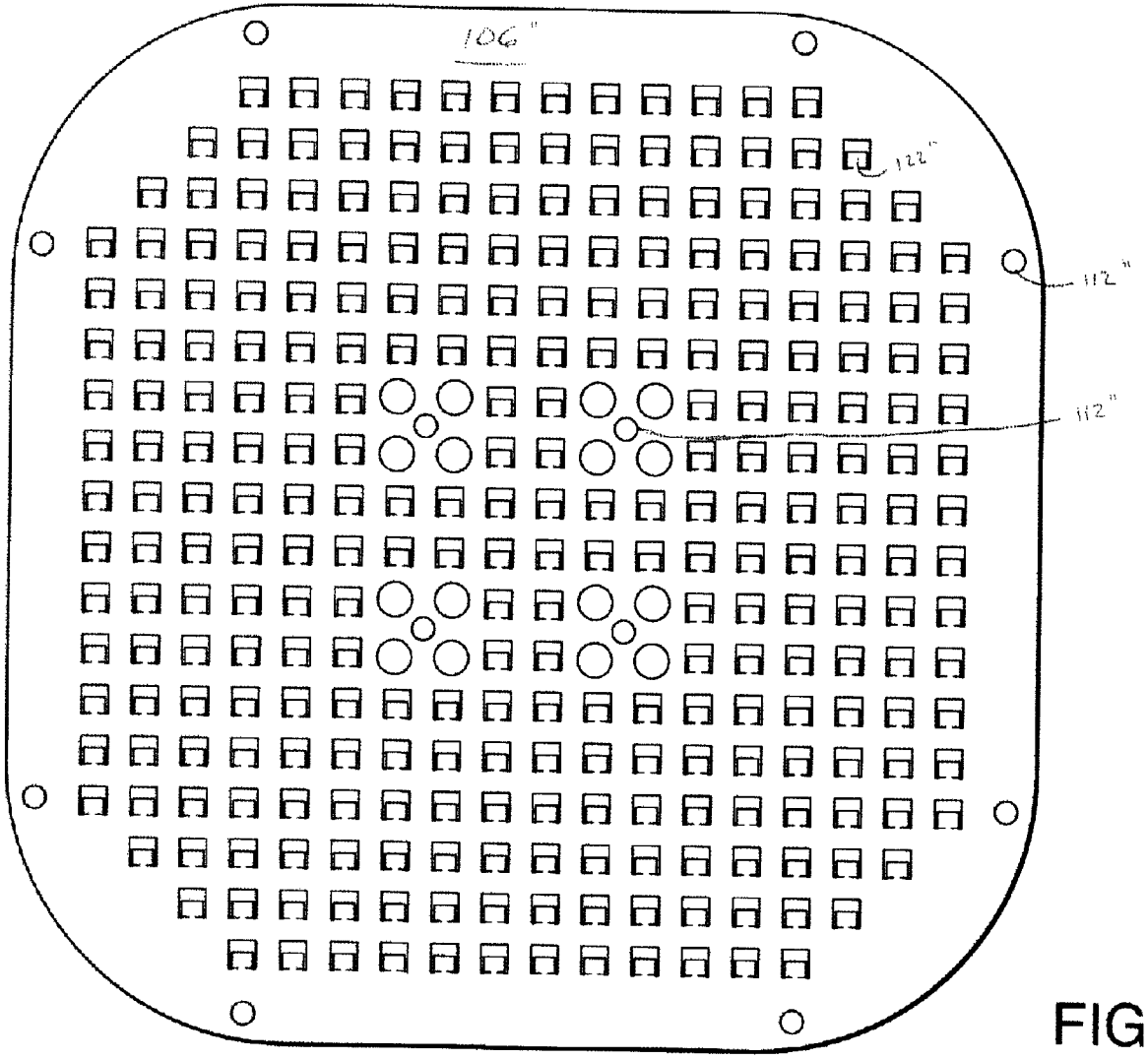
FIG. 7C depicts a flat, stamped sheet material used, in one embodiment, to form the reflector module depicted in FIG. 7A.

Although the reflector modules 104, 104' depicted in FIGS. 1-6C comprise one rear reflector 116, 116' and one forward reflector 117, 117' associated with each light source 102, 102', use of only one reflector associated with each light source is within the scope of this disclosure. One exemplary embodiment is depicted as reflector module 104" in FIGS. 7A-7B. Reflector module 104" comprises a base plate 106" defining a plurality of securing apertures 112" and a plurality of light source apertures 114" to accommodate an array of light sources (not depicted). In the exemplary embodiment depicted in FIGS. 7A-7B, only a single individual reflector 122 extends adjacent to each light source aperture. Like the reflector modules 104, 104' discussed above, the reflectors 122 of the reflector module 104" depicted in FIGS. 7A-7B all extend integrally and individually from the base plate 106". Although only one reflector 122 extends adjacent to each light source aperture 114", some light emitted from a light source in the light source aperture 114" will reflect off of a back side of the reflector 122 extending adjacent to an adjacent light source aperture 114" and impact the light distribution. In the depicted embodiment, the reflectors 122 extending from the base plate 106" all extend integrally from the from the base plate 106" straight at an angle of 45 degrees to the base plate 106" toward the X-direction and for a length of 0.172 inches. It is within the scope of the disclosure, however, that one or more of the reflectors 122 could be angled toward the −X-direction, the Y-direction and/or the −Y-direction. It is within the scope of the disclosure, however, that reflectors 122 could be grouped into sectors, with each sector angled toward one of the X, −X, Y and/or −Y-directions or directions in between. It is also within the scope of the disclosure that the reflectors 122 could be angled differently, or extend longer, or comprise multiple straight reflector segments angled with respect to each other, or be comprised of one or more curved reflector segments such as rear reflectors 116 shown. FIG. 7C depicts a blanked sheet of material from which the reflector module of FIGS. 7A-7B is formed.

Figure 4:
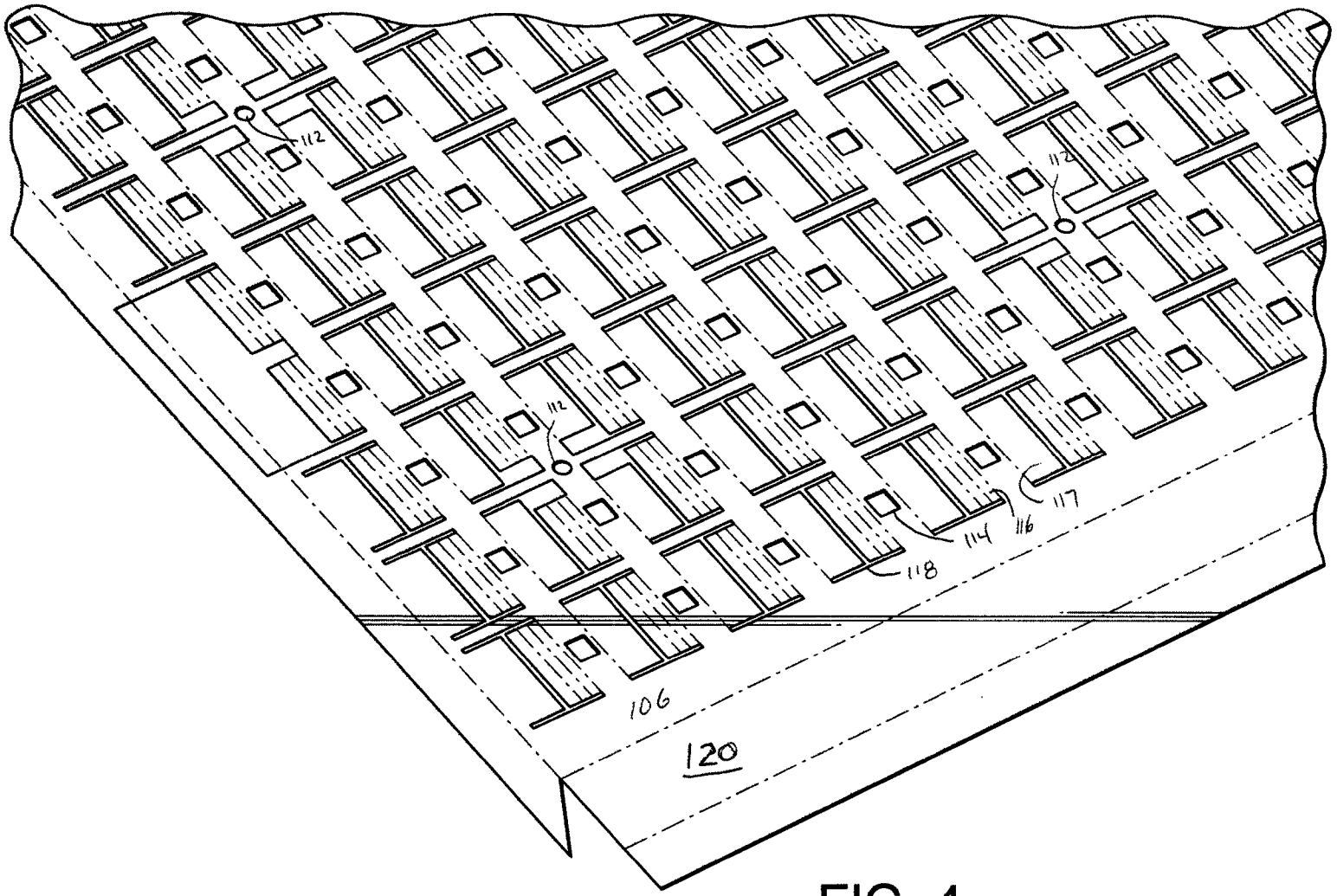
FIG. 4 depicts a flat, stamped sheet material used, in one embodiment, to form the reflector module depicted in FIG. 2.

Having each of the reflector 116, 117, 116', 117' or 122 extend individually from its respective base plate 106, 106', 106", as discussed above, allows for each reflector to be separately formed instead of forming an entire row of reflectors or an entire array of reflectors simultaneously. In one embodiment of the present disclosure, the reflectors associated with each light source (e.g. 116 and 117, or 116' and 117', or 122) are formed sequentially rather than simultaneously so as to permit individualized attention to the formation of each. In one embodiment of this method, a sheet of material 120 is provided from which the reflector module will be formed. Next, the entire sheet 120 is blanked with a blanking die. In one example of this step, the blanking die forms the securing apertures 112, 112" and light source apertures 114, 114" in the sheet of material 120 that will become the base plate 106, 106". In this example, the blanking die also separates the perimeter of the reflectors 116, 117, 116", 117" from the remainder of the sheet 120, thus defining the reflector aperture 118, 118", leaving the reflectors 116, 117, 116", 117" in the reflector aperture 118, 118" at that time. The base plate outer perimeter 108 and the border of the forward, rearward and lateral outer perimeter reflectors 110*a*, 110*b* are also defined. The result of this blanking step for the IESNA Type IV reflector module 104 depicted in FIGS. 1A, 1B, 2 and 3 is depicted in FIG. 4. The result of this blanking step for a sheet of material to manufacture the reflector module 104" can be seen in FIG. 7C.

After the sheet of material 120 is blanked, as described above, the blanked sheet of material 120 undergoes forming to form the reflectors 116 and 117, or 116" and 117", or 122. In one embodiment of this step, each pair of reflectors 116 and 117, or 116" and 117" associated with a light source are formed as a separate operation and the reflector pairs are formed serially such that the reflector module 104 depicted with 128 pairs of rear and forward reflectors 116, 117 will form those 128 pairs serially, one at a time. In the case of reflector modules 104 and 104' this step includes two forming operations in order to properly form the multi-segmented rear reflector 116, 116' such as by precisely defining the angles between reflector segments. The first forming operation comprises using a first forming tool to define pre-bends in the rear reflectors 116 or 116" and fully forming forward reflectors 117, 117" or 122. The second forming operation comprises using a second forming tool to finish the bending of the rear reflectors 116, 116".

In another embodiment of the present disclosure, a method is disclosed for forming reflectors (e.g. 116' and 117') of a reflector module (e.g. 104') having sectors of reflectors in which all reflectors in each sector are oriented in the same direction and the reflectors of each sector are oriented in a different direction from the reflectors of other sectors. In this method, all of the reflectors in each sector are formed simultaneously and the sectors are formed sequentially. In one example of this method of forming, the reflector module of FIGS. 6A-6B is formed by providing a sheet of material, blanking the sheet of material as described above, and then simultaneously forming all of the reflectors in one of the Sectors 1-4, as described above, and then a second of the Sectors 1-4, and so on, until all of the Sectors are completed in a serial fashion.

As discussed above, rear reflectors 116 and forward reflectors 117 of the reflector module 104 depicted in FIGS. 1A, 1B, 2 and 3 and rear reflectors 116' and forward reflectors 117' of the reflector module 104' depicted in FIGS. 6A-6B are configured to direct light from an adjacent light source in a generally forward direction F. More particularly, by extending the rear reflector first segment 116*a* perpendicular to the base plate 106 and progressively angling the second and third segments 116*b*, 116*c* in the forward direction F, the rear reflector approximates a forward curve that redirects most light exiting the light source in the rearward direction toward the forward direction F. As depicted in FIG. 5B, extending the forward reflector 117, 117' from the base plate 106 in the forward direction at an acute angle to the base plate 106 can allow both the light reflected by the rear reflector 116, 116' in the forward direction F and the light emitted in the forward direction F by the light source 102 to either pass the forward reflector 117, 117' without touching it and continue in the forward direction F, or reflect off of the forward reflector 117, 117' and continue in the forward direction F after the reflection.

Figure 5C:
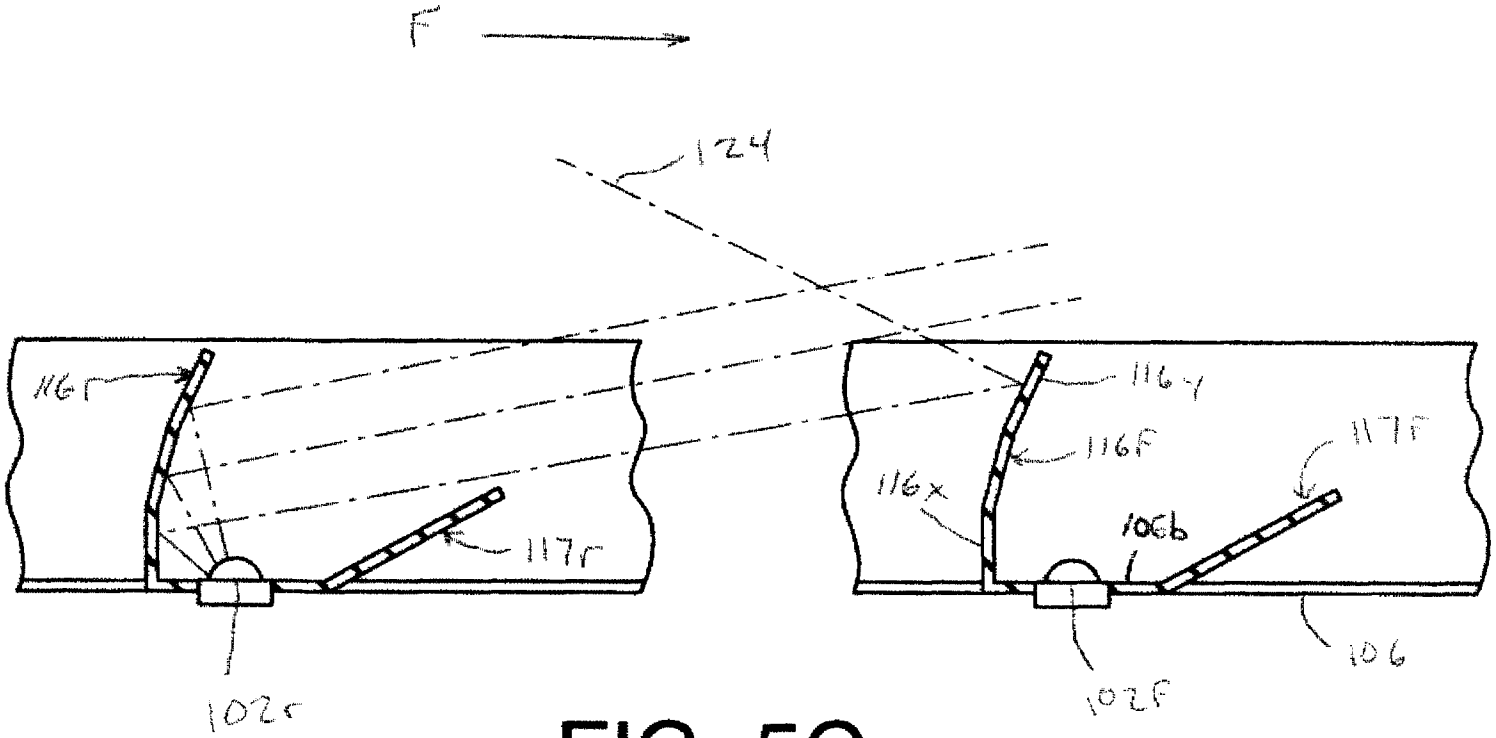
FIG. 5C depicts a cross-sectional view of two light sources and associated portions of the reflector module of FIG. 2.
Figure 5D:
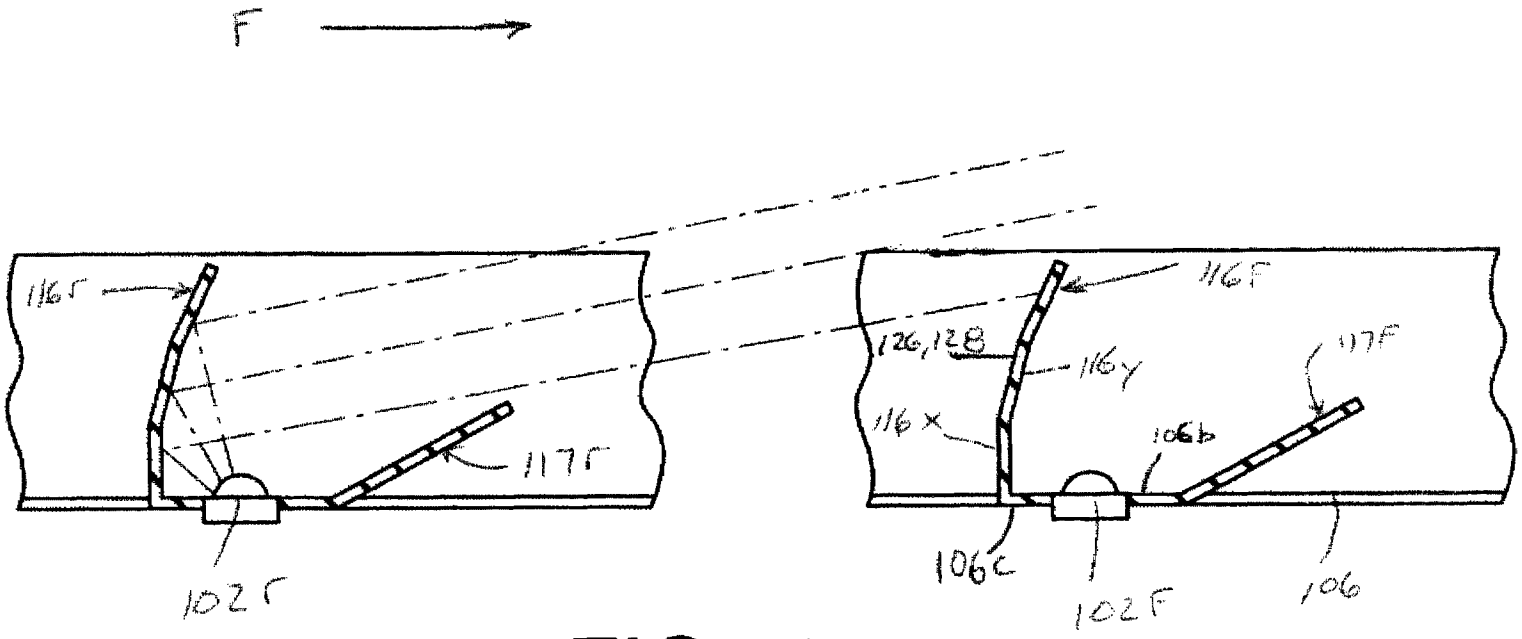
FIG. 5D depicts a cross-sectional view of two light sources and associated portions of the reflector module of FIG. 2 with a light absorbing material applied to a portion thereof.

Depending on the pitch of the light sources 102, light travelling in the forward direction F from one light source 102 might encounter the rear side 116*x* of a rear reflector 116 of an adjacent light source 102 as depicted in FIG. 5C. The direction of the light emitted from the light sources 102 can be controlled with optic lenses (not depicted) placed over the light source. However, the use of such optic lenses can be avoided with properly configured and oriented reflectors 116 and/or 117 and/or 122 and, optionally, light absorbing material to prevent unwanted backlight. One example is depicted in FIG. 5C, which depicts a rearward light source 102*r* on the left having a corresponding rear reflector 116*r* and corresponding forward reflector 117*r* and an adjacent forward light source 102*f* on the right having a corresponding rear reflector 116*f* and forward reflector 117*f*. In one embodiment of the reflector modules of the present disclosure, the base plate 106 is comprised of a sheet of aluminum and in a more particular embodiment, the base plate upper surface 106*b* comprises a high reflectance such as with Alanod Miro-4 Specular Aluminum with the base plate upper surface 106*b* being specular. This high reflectance redirects light from the base plate 106 and from the rear reflectors 116 and forward reflectors 117 formed from the base plate 106. In some instances, it may be desirable to space the light sources 102 and configure the reflectors such that some light emitted from one or more of the light sources will encounter the back of an adjacent reflector associated with an adjacent light source 102. One such situation is depicted in FIG. 5C, showing a small portion of backlight (shown as a single light ray trace 124) created by light from the rearward light source 102*r* encountering and reflecting off of the rear side 116*x* of the adjacent rearward reflector 116*f* associated with the forward light source 102*f*. Even if only the base plate upper surface 106*b* is provided with a high reflectance (e.g. specular), the base plate lower surface 106*c* may also have some material amount of reflectance if the base plate is comprised of aluminum or the like and not treated to remove that reflectance. Thus, although initially travelling in the forward direction F, this backlight 124 is reflected generally in the rearward direction. In some installations, this backlight 124 might not be a concern if the remainder of the light distribution achieves the desired coverage and lumen output. Some installations, however, might prohibit backlight 124. For example, if the luminaire 100 were installed in a parking lot that abuts a residence, the backlight 124 could provide unwanted illumination of that residence, potentially causing neighbor complaints. Alternatively, ordinances, laws or certain desired certifications may prohibit the backlight 124.

The backlight 124 can be eliminated or minimized by applying a light absorbing material 126 to the surface creating the backlight 124. In one embodiment, the light absorbing material can be any material of dark color capable of adhering to the reflector module 104. For example, the light absorbing material can be a black ink, paint, lacquer or vinyl film. Other colors and materials are also contemplated. The light absorbing material can be painted, adhered or deposed (e.g. through physical vapor deposition) onto the reflector module or discrete portions thereof. Aluminum sheeting coated with light absorbing material is available from Alanod GmbH & Co. as MX324. FLEXcon manufactures a FLEXmark V 400 F Black V-23 vinyl sheet for adhering to a sheet of aluminum or the like.

If a reflector module, such as reflector modules 104 and 104' depicted in FIGS. 1-6C, is formed by stamping the sheet of material 120 and forming the sheet of material into the rear and forward reflectors 116, 116', as discussed above, the rear side 116*x* of each rear reflector 116 originated as a portion of the base plate lower surface 106*c*. Therefore, backlight 124 could be prevented by providing an application of a light absorbing material 126 to the entire base plate lower surface 106*c* so that rear reflector rear side 116*x* is darkened (preferably blackened) as soon as the rear reflector 116 is formed from the sheet of material 120.

Alternatively, only select portions of the base plate 106 receive a light absorbing material 124 as necessary to prevent backlight. In one such embodiment, discrete areas 128 of light absorbing material are applied to the back of the sheet of material 120 in the areas that will become the rear reflector rear sides 116*x* so as to completely cover the rear reflector rear sides 116*x* with the light absorbing material. These discrete areas of light absorbing material 128 may be applied before the rear reflectors 116 have been formed out of the plane defined by the base plate 106, they may also be applied after the rear reflectors 116 have been formed. In another embodiment, strips of light absorbing material (not depicted) are applied in rows across the sheet of material lower surface 106*c* before the rear reflectors 116 are formed out of the plane defined by the sheet of material 120, thus leaving some light absorbing material on the base plate lower surface 106*c* after the rear reflectors 116 have been formed. Other applications of light absorbing material will also minimize or eliminate backlight 124 and are also within the scope of this disclosure.

In one further example, the reflector module 104" depicted in FIGS. 7A-7B the upper surface 106*b"* of the base plate 106" is of high reflectance (e.g. specular), but the rear 122*r* of each reflector 122 is at least partially covered (preferably entirely covered) with a light absorbing material. Although the reflector modules 104 and 104' of FIGS. 1-6C were also described, in at least one embodiment, as having base plate upper surface of high reflectance and one or more reflectors with light absorbing material on a rear thereof, those embodiments differ from the reflector module configuration 104" depicted in FIGS. 7A-7B in that the rear of the reflectors in the reflector modules 104 and 104' are formed from the base plate lower surface 106*c* whereas the rear 122*r* of the reflectors 122 of the reflector module 104" depicted in FIGS. 7A-7B are formed from the upper surface 106*b"* of the base plate 106". Thus, in the reflector module 104" depicted in FIGS. 7A-7B a base plate upper surface 106*b"* of high reflectance and a reflector rear 122*r* at least partially covered with light absorbing material cannot be achieved by starting with a sheet of aluminum having one entire surface of high reflectance and one entire surface covered entirely in light absorbing material. Rather, to accomplish an embodiment of reflector module 104" having a base plate upper surface 106" of high reflectance and one or more reflectors with a rear 122*r* at least partially covered with light absorbing material requires discrete application of light absorbing material to the reflector rear 122*r* only, while not applying the light absorbing material to the base plate upper surface 106". Such an application of the light absorbing material can occur before or after formation of the reflectors 122 from the base plate 106" and can be applied in known manners, such as, for example only, by a turret press.

In one embodiment, the reflector module 104 comprises light absorbing material 128 applied to the rear side 116*x* of each rear reflector 116 in the reflector module 104 because each rear reflector faces in the X-direction such that all rear reflectors rear sides 116*x* necessarily face a light source 102 and the −X-direction such that any backlight 124 would travel in the −X-direction of the luminaire 100. In some embodiments, backlight 124 from less than all of the rear reflectors 116 might be of concern. For example, the reflector modules of the present disclosure permits reflectors being oriented in multiple directions, such as the IESNA Type V reflector module 104' depicted in FIGS. 6A-6B. In one embodiment, only those reflectors that could create backlight 124 directed toward an area intended to be kept dark, such as the aforementioned residential home or the like are desired to be prevented.

In one exemplary embodiment, a reflector module defines at least two sectors of different reflectors comprising a first sector with a reflectors oriented such that light from an adjacent light source would reflect from the reflector rear side to create backlight directed toward the area intended to be kept dark, and a second sector with reflectors oriented such that light from an adjacent light source would reflect from the reflector rear side to create backlight directed toward an area not intended to be kept dark. Light absorbing material is applied to the rear side of reflectors in the first sector, but not the second sector. In one possible application of this embodiment, light absorbing material is applied to the rear reflector rear side 116*x* for each rear reflector 116' in Sector 2, but not Sectors 1, 3 or 4.

As stated above, the entire reflector module 104, 104', 104" can be formed from a single sheet of material (e.g. sheet 120). In one embodiment, this sheet of material is sheet metal with a high reflectance such as Alanod Miro-4 Specular Aluminum. Other materials are also contemplated.

The LEDs used as the light sources 102, 102' in exemplary embodiments herein can be of any kind, color (e.g., emitting any color or white light or mixture of colors and white light as the intended lighting arrangement requires) and luminance capacity or intensity, preferably in the visible spectrum. Color selection can be made as the intended lighting arrangement requires. In accordance with the present disclosure, LEDs can comprise any semiconductor configuration and material or combination (alloy) that produces the intended array of color or colors. The LEDs can have a refractive optic built-in with the LED or placed over the LED, or no refractive optic; and can alternatively, or also, have a surrounding reflector, e.g., that re-directs low-angle and mid-angle LED light outwardly. In one suitable embodiment, the LEDs are white LEDs each comprising a gallium nitride (GaN)-based light emitting semiconductor device coupled to a coating containing one or more phosphors. The GaN-based semiconductor device can emit light in the blue and/or ultraviolet range, and excites the phosphor coating to produce longer wavelength light. The combined light output can approximate a white light output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light (or another desired color). In yet another suitable embodiment, colored LEDs are used, such are phosphide-based semiconductor devices emitting red or green light, in which case the LED assembly produces light of the corresponding color. In still yet another suitable embodiment, the LED light board may include red, green, and blue LEDs distributed on the printed circuit board in a selected pattern to produce light of a selected color using a red-green-blue (RGB) color composition arrangement. In this latter exemplary embodiment, the LED light board can be configured to emit a selectable color by selective operation of the red, green, and blue LEDs at selected optical intensities. Clusters of different kinds and colors of LED are also contemplated to obtain the benefits of blending their output.

Although the embodiments described herein use LEDs to generate light rays, other light sources are also contemplated. The disclosed luminaire is not limited to use of LEDs.

While certain embodiments have been described herein, it will be understood by one skilled in the art that the methods, systems, and apparatus of the present disclosure may be embodied in other specific forms without departing from the spirit thereof. For example, while aspects and embodiments herein have been described in the context of certain applications, the present disclosure is not limited to such; for example, embodiments of the present disclosure may be utilized generally for any light distribution applications.

Accordingly, the embodiments described herein, and as claimed in the attached claims, are to be considered in all respects as illustrative of the present disclosure and not restrictive.

What is claimed is:

1. A luminaire comprising:

a first row of light sources extending in the X-direction of the luminaire and comprising a first light source and a second light source;

a second row of light sources extending in the X-direction of the luminaire and comprising a third light source and a fourth light source, the second row of light sources displaced in the Y-direction from the first row of light sources;

a reflector module, the reflector module comprising:

a planar base plate, the base plate defining a first light source aperture associated with the first light source, a second light source aperture associated with the second light source, and a first reflector aperture between the first light source aperture and the second light source aperture, the first reflector aperture defining a perimeter;

a first light source forward reflector integrally extending from the reflector aperture perimeter adjacent the first light source aperture, the first light source forward reflector comprised of material displaced from the base plate to define the first reflector aperture;

a second light source rear reflector integrally extending from the reflector aperture perimeter adjacent the second light source aperture, the second light source rear reflector comprised of material displaced from the base plate to define the first reflector aperture;

a third light source aperture defined in the base plate and associated with the third light source, a fourth light source aperture defined in the base plate and associated with the fourth light source, and a second reflector aperture defined in the base plate between the third light source aperture and the fourth light source aperture, the second reflector aperture defining a perimeter;

a third light source forward reflector integrally extending from the second reflector aperture perimeter adjacent the third light source aperture, the third light source forward reflector comprised of material displaced from the base plate to define the second reflector aperture; and a fourth light source rear reflector integrally extending from the second reflector aperture perimeter adjacent the fourth light source aperture, the fourth light source rear reflector comprised of material displaced from the base plate to define the second reflector aperture;

wherein the first light source forward reflector, the second light source rear reflector, the third light source forward reflector, the fourth light source rear reflector are each individual reflectors.

2. The luminaire of claim 1, wherein the base plate is comprised of sheet metal.

3. The luminaire of claim 1, the first light source comprising a light emitting diode.

4. The luminaire of claim 1 configured to produce a light distribution approximating an IESNA Type IV light distribution.

5. The luminaire of claim 1 configured to produce a light distribution approximating an IESNA Type V light distribution.

6. A luminaire comprising:

a first row of light sources extending in the X-direction of the luminaire and comprising a first light source and a second light source;

a second row of light sources extending in the X-direction of the luminaire and comprising a third light source and a fourth light source, the second row of light sources displaced in the Y-direction from the first row of light sources;

a third row of light sources extending in the Y-direction of the luminaire and comprising a fifth light source and a sixth light source;

a fourth row of light sources extending in the Y-direction of the luminaire and comprising a seventh light source and a eighth light source, the fourth row of light sources displaced in the X-direction from the first row of light sources;

a reflector module, the reflector module comprising:

a planar base plate, the base plate defining a first light source aperture associated with the first light source, a second light source aperture associated with the second light source, and a first reflector aperture between the first light source aperture and the second light source aperture, the first reflector aperture defining a perimeter;

a first light source forward reflector integrally extending from the first reflector aperture perimeter adjacent the first light source aperture, the first light source forward reflector comprised of material displaced from the base plate to define the first reflector aperture;

a second light source rear reflector integrally extending from the first reflector aperture perimeter adjacent the second light source aperture, the second light source rear reflector comprised of material displaced from the base plate to define the first reflector aperture;

a third light source aperture defined in the base plate and associated with the third light source, a fourth light source aperture defined in the base plate and associated with the fourth light source, and a second reflector aperture defined in the base plate between the third light source aperture and the fourth light source aperture, the second reflector aperture defining a perimeter;

a third light source forward reflector integrally extending from the second reflector aperture perimeter adjacent the third light source aperture, the third light source forward reflector comprised of material displaced from the base plate to define the second reflector aperture;

a fourth light source rear reflector integrally extending from the second reflector aperture perimeter adjacent the fourth light source aperture, the fourth light source rear reflector comprised of material displaced from the base plate to define the second reflector aperture;

wherein the first light source forward reflector, the second light source rear reflector, the third light source forward reflector, the fourth light source rear reflector are each individual reflectors;

the base plate defining a fifth light source aperture associated with the fifth light source, a sixth light source aperture associated with the sixth light source, and a third reflector aperture between the fifth light source aperture and the sixth light source aperture, the third reflector aperture defining a perimeter;

a fifth light source forward reflector integrally extending from the third reflector aperture perimeter adjacent the first light source aperture, the fifth light source forward reflector comprised of material displaced from the base plate to define the third reflector aperture;

a sixth light source rear reflector integrally extending from the third reflector aperture perimeter adjacent the sixth light source aperture, the sixth light source rear reflector comprised of material displaced from the base plate to define the third reflector aperture;

a seventh light source aperture defined in the base plate and associated with the seventh light source, a eighth light source aperture defined in the base plate and associated with the eighth light source, and a fourth reflector aperture defined in the base plate between the seventh light source aperture and the eighth light source aperture, the fourth reflector aperture defining a perimeter;

a seventh light source forward reflector integrally extending from the fourth reflector aperture perimeter adjacent the seventh light source aperture, the seventh light source forward reflector comprised of material displaced from the base plate to define the fourth reflector aperture; and an eighth light source rear reflector integrally extending from the eighth reflector aperture perimeter adjacent the eighth light source aperture, the eighth light source rear reflector comprised of material displaced from the base plate to define the fourth reflector aperture;

wherein the fifth light source forward reflector, the sixth light source rear reflector, the seventh light source forward reflector, the eighth light source rear reflector are each individual reflectors.

7. The luminaire of claim 6, wherein the base plate is comprised of sheet metal.

8. The luminaire of claim 6, the first light source comprising a light emitting diode.

9. The luminaire of claim 6 configured to produce a light distribution approximating an IESNA Type V light distribution.

10. A luminaire comprising:

an array of light sources;

a reflector module to be associated with the array of light sources to form a light distribution, the reflector module comprising:

a planar base plate;

a first sector of reflectors comprising:

a first reflector extending integrally from the base plate adjacent a first light source aperture defined in the base plate and associated with a first light source of the array of light sources, the first reflector defining a front facing the first light source aperture, and the first reflector not extending adjacent to any light source aperture other than the first light source aperture;

a second reflector extending integrally from the base plate adjacent a second light source aperture defined in the base plate and associated with a second light source of the array of light sources, the second reflector defining a front facing the second light source aperture, and the second reflector not extending adjacent to any light source aperture other than the second light source aperture;

the first reflector spaced from the second reflector in the X-direction, and the front of the first reflector and the front of the second reflector facing in an X-direction of the luminaire;

a second sector of reflectors comprising:

a third reflector extending integrally from the base plate adjacent a third light source aperture defined in the base plate and associated with a third light source of the array of light sources, the third reflector defining a front facing the third light source aperture, and the third reflector not extending adjacent to any light source aperture other than the third light source aperture;

a fourth reflector extending integrally from the base plate adjacent a fourth light source aperture defined in the base plate and associated with a fourth light source of the array of light sources, the fourth reflector defining a front facing the fourth light source aperture, and the fourth reflector not extending adjacent to any light source aperture other than the fourth light source aperture; and the third reflector spaced from the fourth reflector in the Y-direction, and the front of the third reflector and the front of the fourth reflector facing in a Y-direction of the luminaire.

11. The luminaire of claim 10, the light sources are light emitting diodes.

12. The luminaire of claim 10 configured to produce a light distribution approximating an IESNA Type V light distribution.

13. The luminaire of claim 10 wherein the first and second light sources are aligned in the Y-direction.

14. The luminaire of claim 13 wherein the third and fourth light sources are aligned in the X-direction.

15. The luminaire of claim 10 further comprising a third sector of reflectors comprising:

a fifth reflector extending integrally from the base plate adjacent a fifth light source aperture defined in the base plate and associated with a fifth light source of the array of light sources, the fifth reflector defining a front facing the fifth light source, and the fifth reflector not extending adjacent to any light source other than the fifth light source;

a sixth reflector extending integrally from the base plate adjacent a sixth light source aperture defined in the base plate and associated with a sixth light source of the array of light sources, the sixth reflector defining a front facing the sixth light source, and the sixth reflector not extending adjacent to any light source other than the sixth light source; and the front of the fifth reflector and the front of the sixth reflector facing in a −X-direction of the luminaire.

16. The luminaire of claim 15 further comprising a fourth sector of reflectors comprising:

a seventh reflector extending integrally from the base plate adjacent a seventh light source aperture defined in the base plate and associated with a seventh light source of the array of light sources, the seventh reflector defining a front facing the seventh light source, and the seventh reflector not extending adjacent to any light source other than the seventh light source;

an eighth reflector extending integrally from the base plate adjacent an eighth light source aperture defined in the base plate and associated with an eighth light source of the array of light sources, the eighth reflector defining a front facing the eighth light source, and the eighth reflector not extending adjacent to any light source other than the eighth light source; and the front of the seventh reflector and the front of the eighth reflector facing in a -Y -direction of the luminaire.

17. A luminaire comprising:

a first light source and a second light source, the second light source being forward of the first light source;

a planar reflector module, the reflector module comprising:

a base plate having a lower surface comprising a light absorbing material and a reflective upper surface, the base plate defining a first light source aperture associated with the first light source, a second light source aperture associated with the second light source;

a second light source rear reflector integrally extending adjacent to the second light source aperture, the second light source rear reflector defining a rear face facing the first light source and a front face facing the second light source, the rear face of the second light source rear reflector at least partially covered with the light absorbing material on the base plate lower surface;

the base plate defining a reflector aperture between the first light source aperture and the second light source aperture, the reflector aperture defining a perimeter, a first light source forward reflector integrally extending from the reflector aperture perimeter adjacent the first light source aperture; and wherein the first light source forward reflector is comprised of material removed from the base plate to define the reflector aperture and the second light source rear reflector is comprised of material removed from the base plate to define the reflector aperture such that the rear face of the second light source rear reflector is formed from the base plate lower surface.

18. The luminaire of claim 17, wherein the light absorbing material is ink, paint or lacquer.

19. The luminaire of claim 17, wherein the light absorbing material is black.

20. The luminaire of claim 17 configured to produce a light distribution approximating an IESNA Type IV light distribution.

21. The luminaire of claim 17 wherein the entire upper surface of the base plate is reflective.

22. A luminaire configured to form a light distribution casting light in at least an X-direction of the luminaire and minimizing light cast in the −X direction of the luminaire, the luminaire comprising:

an array of light sources;

a reflector module to be associated with the array of light sources to produce the light distribution, the reflector module comprising:

a planar base plate having a lower surface comprising a light absorbing material and a reflective upper surface;

a first sector of reflectors comprising:

a first reflector extending integrally from the base plate adjacent a first light source aperture defined in the base plate and associated with a first light source of the array of light sources, the first reflector defining a front facing the first light source and a rear facing the opposite direction, the front face of the first reflector formed from the base plate reflective upper surface and the rear face of the first reflector formed from the base plate lower surface and at least partially covered with the light absorbing material;

a second reflector extending integrally from the base plate adjacent a second light source aperture defined in the base plate and associated with a second light source of the array of light sources, the second reflector defining a front facing the second light source and a rear facing the opposite direction the front face of the second reflector formed from the base plate reflective upper surface and, the rear face of the second reflector formed from the base plate lower surface and at least partially covered with the light absorbing material;

the front of the first reflector and the front of the second reflector facing in an X-direction of the luminaire;

a second sector of reflectors comprising:

a third reflector extending integrally from the base plate adjacent a third light source aperture defined in the base plate and associated with a third light source of the array of light sources, the third reflector defining a front facing the third light source and a rear facing the opposite direction, the rear face of the third reflector not having any light absorbing material;

a fourth reflector extending integrally from the base plate adjacent a fourth light source aperture defined in the base plate and associated with a fourth light source of the array of light sources, the fourth reflector defining a front facing the fourth light source and a rear facing the opposite direction, the rear face of the fourth reflector not having any light absorbing material; and the front of the third reflector and the front of the fourth reflector facing in a Y-direction of the luminaire.

23. The luminaire of claim 22, the light sources are light emitting diodes.

24. The luminaire of claim 22 configured to produce a light distribution approximating an IESNA Type V light distribution.

25. The luminaire of claim 22 wherein the first and second light sources are aligned in the Y-direction.

26. The luminaire of claim 25 wherein the third and fourth light sources are aligned in the X-direction.

27. The luminaire of claim 22, the first reflector not extending adjacent to any light source other than the first light source, the second reflector not extending adjacent to any light source aperture other than the second light source, the third reflector not extending adjacent to any light source other than the third light source, and the fourth reflector not extending adjacent to any light source other than the fourth light source.

* * * * *